US011272737B2

(12) United States Patent
Watanabe et al.

(10) Patent No.: US 11,272,737 B2
(45) Date of Patent: Mar. 15, 2022

(54) VAPOR GENERATION UNIT FOR NON-COMBUSTION-TYPE FLAVOR INHALER AND PRODUCTION METHOD FOR VAPOR GENERATION UNIT FOR NON-COMBUSTION-TYPE FLAVOR INHALER

(71) Applicant: JAPAN TOBACCO INC., Tokyo (JP)

(72) Inventors: Tomoichi Watanabe, Tokyo (JP); Toshiki Kudo, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 0 days.

(21) Appl. No.: 17/349,569

(22) Filed: Jun. 16, 2021

(65) Prior Publication Data

US 2021/0307393 A1 Oct. 7, 2021

Related U.S. Application Data

(63) Continuation of application No. PCT/JP2019/043138, filed on Nov. 1, 2019.

(30) Foreign Application Priority Data

Mar. 8, 2019 (JP) ..... JP2019-042739

(51) Int. Cl.
*A24F 40/44* (2020.01)
*A24F 40/70* (2020.01)
(Continued)

(52) U.S. Cl.
CPC ..... *A24F 40/44* (2020.01); *A24F 40/10* (2020.01); *A24F 40/46* (2020.01); *A24F 40/70* (2020.01);
(Continued)

(58) Field of Classification Search
CPC ..... A24F 40/10; A24F 40/44; A24F 40/46; A24F 40/70; H05B 3/03; H05B 3/06
See application file for complete search history.

(56) References Cited

U.S. PATENT DOCUMENTS 5,144,962 A * 9/1992 Counts ..... A24F 40/46 131/194
2011/0155153 A1 6/2011 Thorens et al.
(Continued)

FOREIGN PATENT DOCUMENTS

JP 2013-516159 A 5/2013
JP 2016-511008 A 4/2016
(Continued)

OTHER PUBLICATIONS

International Search Report for PCT/JP2019/043138 dated Dec. 24, 2019.

*Primary Examiner* — Erin E McGrath
(74) *Attorney, Agent, or Firm* — Birch, Stewart, Kolasch & Birch, LLP

(57) ABSTRACT

A vapor generation unit is for use in a non-combustion-type flavor inhaler that includes a wick, a wick support, a heater, a holder, and a positioning mechanism. The wick holds a liquid and is attached to the wick support. The heater includes a housing space that houses a wick assembly that is formed from the wick and the wick support and a heater element that is contacted by the wick. The holder is assembled on the heater element side of an assembly that is formed from the heater and the wick assembly. The positioning mechanism makes it possible for the wick assembly to be housed in the housing space such that the wick is not in contact with the heater element and moves the wick assembly as housed in the housing space so as to position the wick assembly such that the wick is in contact with the heater element.

27 Claims, 24 Drawing Sheets

(51) Int. Cl.

| | |
|---|---|
| ***A24F 40/10*** | (2020.01) |
| ***A24F 40/46*** | (2020.01) |
| ***H05B 3/03*** | (2006.01) |
| ***H05B 3/06*** | (2006.01) |

(52) U.S. Cl.
CPC ..... *H05B 3/03* (2013.01); *H05B 3/06* (2013.01); *H05B 2203/016* (2013.01)

(56) References Cited

U.S. PATENT DOCUMENTS

| | | | | |
|---|---|---|---|---|
| 2014/0270729 | A1* | 9/2014 | DePiano | A24F 40/40 392/397 |
| 2015/0272218 | A1* | 10/2015 | Chen | A61M 11/042 131/329 |
| 2016/0044962 | A1* | 2/2016 | Thorens | A24F 40/44 392/395 |
| 2017/0095003 | A1* | 4/2017 | Mironov | A24F 40/465 |
| 2017/0188626 | A1 | 7/2017 | Davis et al. | |
| 2017/0340014 | A1* | 11/2017 | Batista | A24F 40/46 |
| 2017/0340015 | A1* | 11/2017 | Thorens | A24F 40/44 |
| 2018/0263294 | A1 | 9/2018 | Qiu | |

FOREIGN PATENT DOCUMENTS

| | | | |
|---|---|---|---|
| JP | 2019-500895 | A | 1/2019 |
| WO | WO 2014/150979 | A2 | 9/2014 |

* cited by examiner

VAPOR GENERATION UNIT FOR NON-COMBUSTION-TYPE FLAVOR INHALER AND PRODUCTION METHOD FOR VAPOR GENERATION UNIT FOR NON-COMBUSTION-TYPE FLAVOR INHALER

CROSS REFERENCE TO RELATED APPLICATIONS

This application is a Continuation of PCT International Application No. PCT/JP2019/043138, filed on Nov. 1, 2019, which claims priority under 35 U.S.C. 119(a) to Patent Application No. 2019-042739, filed in Japan on Mar. 8, 2019, all of which are hereby expressly incorporated by reference into the present application.

TECHNICAL FIELD

The present invention relates to a vapor generation unit for a non-combustion-type flavor inhaler and a production method for the vapor generation unit.

BACKGROUND ART

Conventionally, a non-combustion-type flavor inhaler for inhaling a flavor without combusting a material has been known. Such an inhaler is called, for example, an electronic cigarette or a heating cigarette, and includes a vapor generation unit that generates a vapor by heating a liquid. The vapor generated by the vapor generation unit is cooled when passing through the inhaler to be an aerosol, and the aerosol is inhaled after passing through a flavor source.

PTL 1 discloses a method for assembling a cartridge for an aerosol delivery device or a cartridge for a smoking implement. A vapor generation unit that is an atomizer included in the cartridge has a heater for heating a liquid to generate a vapor, and the heater includes a wick (liquid holding member) that is a rod-shaped liquid transport element and a heater element that is a wire extending in the longitudinal direction of the wick. The heater element generates a vapor by heating the liquid held by the wick using the heater element wound around the rod-shaped wick in a coil shape.

CITATION LIST

Patent Literature

PTL 1: Japanese Unexamined Patent Application Publication (Translation of PCT Application) No. 2016-511008

SUMMARY OF INVENTION

Technical Problem

In PTL 1, it is difficult to automate the operation of winding the coil-shaped heater element around the rod-shaped wick, and even if the operation can be automated, a device that performs a complicated operation is required. Hence, the productivity of the heater and the vapor generation unit may be deteriorated. In PTL 1, no special consideration is given to a production method for the vapor generation unit including the heater.

In addition, in PTL 1, in order to ensure a space for the operation of winding the coil-shaped heater element around the rod-shaped wick, the contact of the wick with respect to the heater element needs to be at a position separated from a heater base in the axial direction. Hence, it is difficult to make the heater and the vapor generation unit compact. Thus, there is still a problem in improving the reliability and productivity of the vapor generation unit while ensuring the performance of the vapor generation unit required for the non-combustion-type flavor inhaler and further making the vapor generation unit compact.

The present invention has been made in view of such a problem, and an object of the present invention is to provide a vapor generation unit for a non-combustion-type flavor inhaler and a production method for the vapor generation unit capable of improving the reliability and productivity of the vapor generation unit while making the vapor generation unit compact.

Solution to Problem

To attain the object, a vapor generation unit for a non-combustion-type flavor inhaler according to the present invention is a vapor generation unit for a non-combustion-type flavor inhaler that generates a vapor by heating a liquid. The vapor generation unit includes a wick that holds the liquid; a wick support to which the wick is attached; a heater having a housing space in which a wick assembly formed of the wick and the wick support is housed and including a heater element with which the wick comes into contact; a holder that is assembled to a side of the heater element of an assembly including the heater and the wick assembly; and a positioning mechanism that allows the wick assembly to be housed in the housing space at a non-contact position at which the wick is not in contact with the heater element and that causes the wick assembly housed in the housing space to move to a contact position at which the wick is in contact with the heater element to position the wick assembly.

In addition, a production method for a vapor generation unit for a non-combustion-type flavor inhaler according to the present invention is a production method for a vapor generation unit for a non-combustion-type flavor inhaler that generates a vapor by heating a liquid. The vapor generation unit includes a wick that holds the liquid, a wick support to which the wick is attached, a heater that houses a wick assembly formed of the wick and the wick support and that includes a heater element with which the wick comes into contact, and a holder that is assembled to a side of the heater element of an assembly including the heater and the wick assembly. The method includes a heater supply step of supplying the heater; a wick assembly supply step of forming the wick assembly and causing the wick assembly to be housed in a housing space of the heater at a non-contact position at which the wick is not in contact with the heater element; a wick assembly positioning step of causing the wick assembly housed in the housing space at the non-contact position to move to a contact position at which the wick is in contact with the heater element to position the wick assembly; and a holder supply step of assembling the holder to the heater in which the wick assembly is positioned.

Advantageous Effects of Invention

With the vapor generation unit for a non-combustion-type flavor inhaler and the production method for the vapor generation unit, the reliability and productivity of the vapor generation unit can be improved while making the vapor generation unit compact.

DESCRIPTION OF EMBODIMENTS

Hereinafter, a vapor generation unit 1 (hereinafter, also referred to as VGU in an abbreviated manner) for a non-combustion-type flavor inhaler and a production method for the VGU 1 according to each embodiment of the present invention will be described with reference to the accompanying drawings.

First Embodiment

Figure 1:
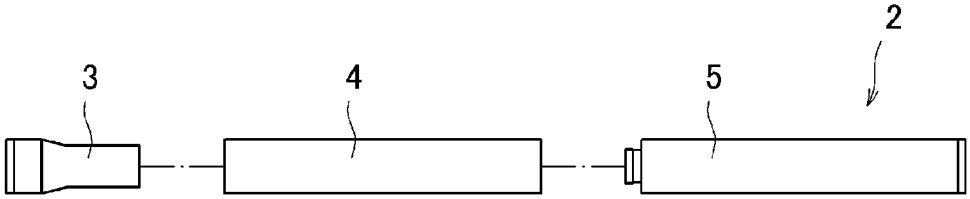
FIG. 1 is a side view of a non-combustion-type flavor inhaler including a vapor generation unit according to a first embodiment of the present invention when disassembled for each unit.
Figure 2:
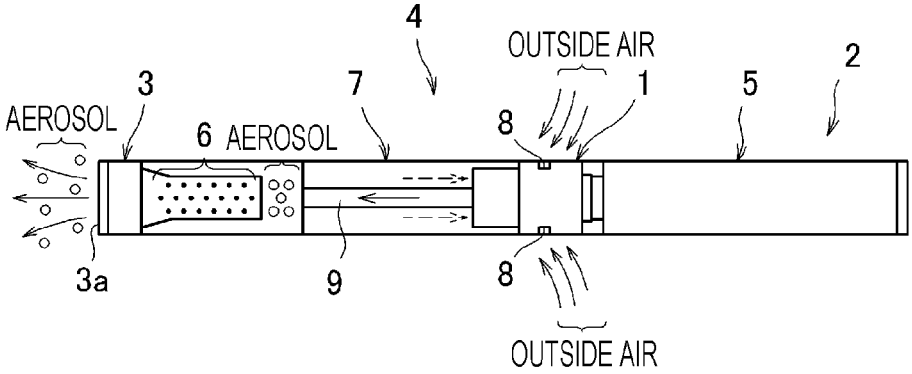
FIG. 2 is a diagram for explaining the function of each unit of the non-combustion-type flavor inhaler of FIG. 1.

FIG. 1 is a side view of a non-combustion-type flavor inhaler 2 (hereafter, also simply referred to as an inhaler) including a VGU 1 according to a first embodiment of the present invention when the VGU 1 is disassembled for each unit, and FIG. 2 provides an explanatory view of the function of each unit of the inhaler 2.

The inhaler 2 is formed by connecting a capsule unit 3, an atomizer unit 4, and a battery unit 5 in the axial direction of the inhaler 2. A flavor source 6 is disposed in the capsule unit 3, and the VGU 1 and a tank 7 that stores a liquid containing an aerosol forming material are disposed in the atomizer unit 4. The battery unit 5 is connected to the atomizer unit 4 to supply electric power to the VGU 1.

A liquid in the tank 7 is guided to the VGU 1 as indicated by broken-line arrows in FIG. 2. The VGU 1 generates a vapor by heating the guided liquid, and the vapor is cooled when passing through a flow path 9 (described later) to generate an aerosol. The liquid stored in the tank 7 contains, for example, glycerin or propylene glycol as the aerosol forming material.

The flavor source 6 is at least any one of shredded tobacco, a formed body obtained by forming a tobacco raw material into a granular shape or a sheet shape, a plant other than tobacco, other flavors, and the like, and is housed in the capsule unit 3 so as not to leak. The liquid in the tank 7 may contain nicotine. In some cases, the capsule unit 3 does not include the flavor source 6. In this case, the capsule unit 3 is simply used as an inhalation port member (for example, mouthpiece).

At least one vent hole 8 for taking outside air into the atomizer unit 4 is formed in the VGU 1. When a user inhales from an inhalation port end 3*a* of the capsule unit 3, as illustrated by solid-line arrows in FIG. 2, outside air is taken into the atomizer unit 4 from, for example, two vent holes 8.

The flow path 9 partitioned from the liquid stored in the tank 7 is formed in a central portion in the tank 7 of the atomizer unit 4. The vapor generated in the VGU 1 is cooled to be an aerosol when passing through the flow path 9 together with the outside air taken in from each vent hole 8, and the aerosol passes through the flavor source 6 of the capsule unit 3 and is guided to the mouth of the user. The user can take in the component of the flavor source 6 by inhaling the aerosol that has passed through the flavor source 6.

Figure 3:
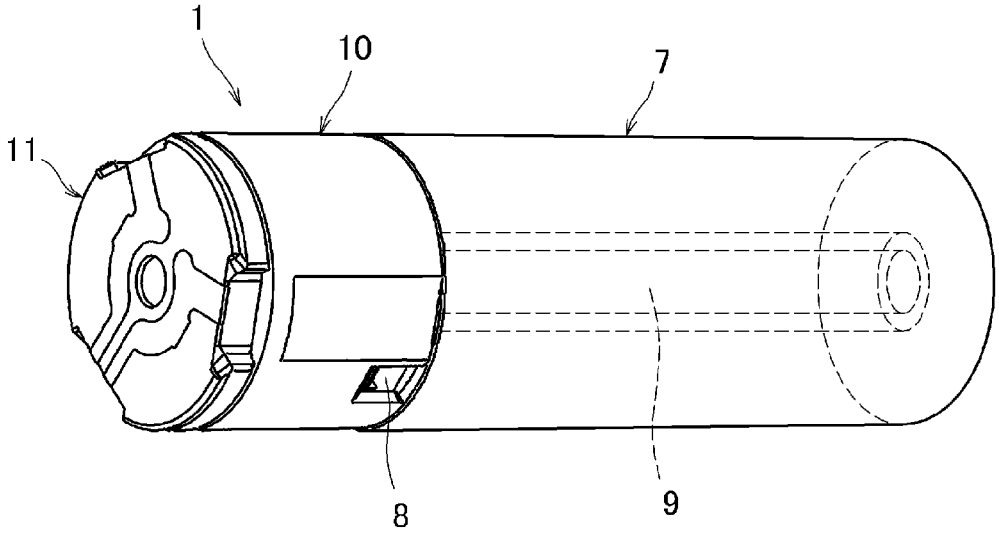
FIG. 3 is a perspective view illustrating a state in which a vapor generation unit of FIG. 2 is connected to a tank.

FIG. 3 is a perspective view of the VGU 1 connected to the tank 7. The VGU 1 includes a holder 10 inserted into and assembled to the tank 7, and a heater 11 to which the holder 10 is inserted and assembled and which is electrically connected to the battery unit 5. The liquid in the tank 7 is enclosed in a space other than the flow path 9 in a state in which the VGU 1 is connected to the tank 7 as illustrated in FIG. 3.

Figure 4:
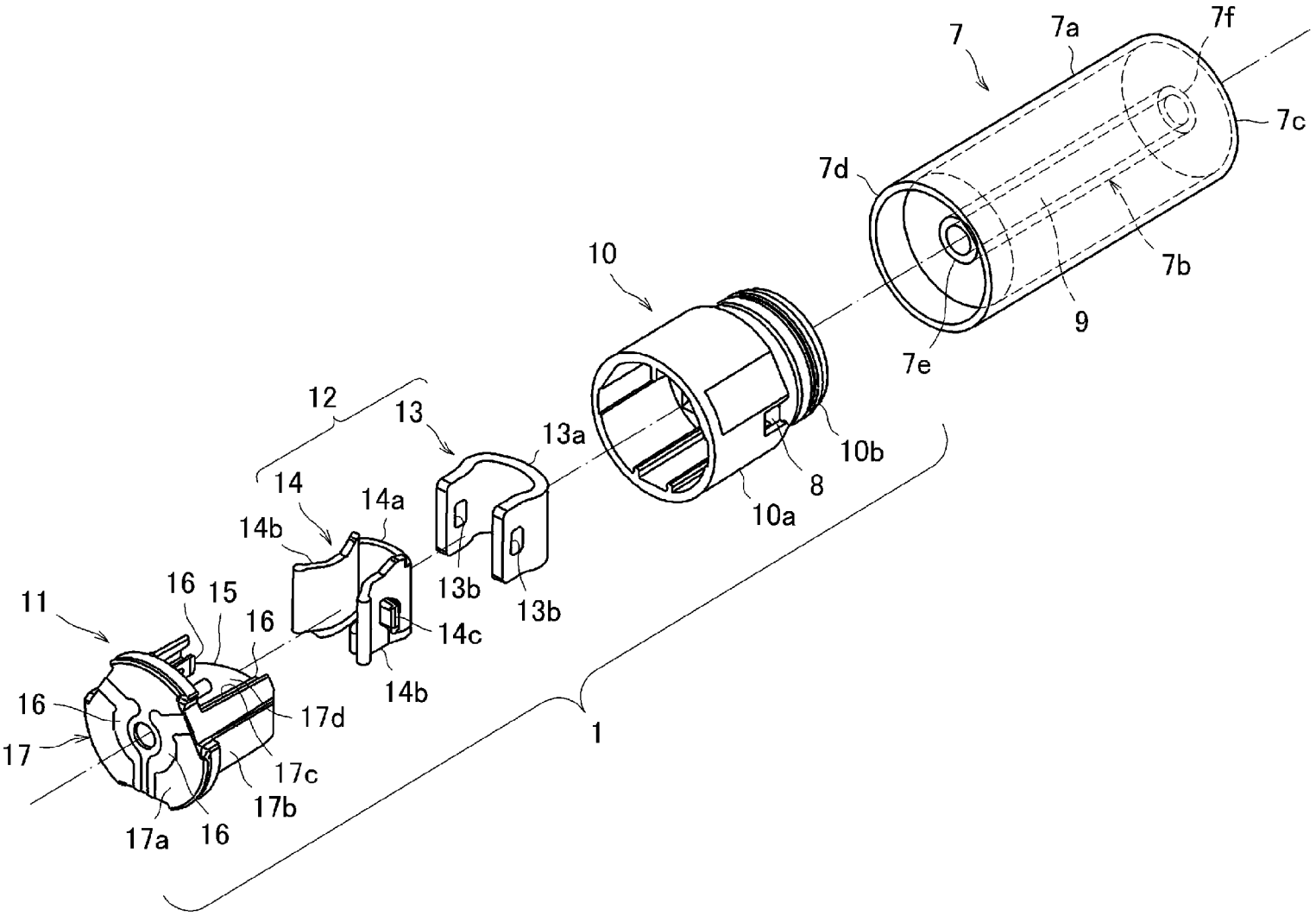
FIG. 4 is an exploded perspective view of FIG. 3.

FIG. 4 is an exploded perspective view of the VGU 1 of FIG. 3. The VGU 1 further includes a wick assembly 12 assembled to the holder 10. Hereinafter, in FIG. 4, a one-dot chain line connecting each component in the VGU 1 is defined as the axial direction of each component or the height direction of each component, and the direction orthogonal to the axial direction is defined as the radial direction of each component. Further, for a cap-shaped component, the direction extending around the one-dot chain line may be referred to as the circumferential direction of the component.

The wick assembly 12 includes a wick 13 that holds the liquid in the tank 7 and a wick support 14 to which the wick 13 is attached. The tank 7 is made of, for example, resin and has a bottomed cylindrical shape. The tank 7 has a peripheral wall 7*a* that defines the outer peripheral edge of the tank 7, a pipe 7*b* that defines the flow path 9 in the central portion of the tank 7, a bottom portion 7*c* connected to the capsule unit 3, and an opening 7*d* to which the holder 10 is connected.

One end of the pipe 7*b* that is open on the side of the opening 7*d* is used as a connection portion 7*e* for connection to an air guide port 10*c* (described later) of the holder 10. The other end of the pipe 7*b* penetrates through the bottom portion 7*c*, is open on the side of the capsule unit 3, and is used as a connection portion 7*f* for connection to the capsule unit 3.

The heater 11 includes a heater element 15 that is, for example, one wire, a pair of electrodes 16 that cause the heater element 15 to generate heat by being supplied with electric power from the battery unit 5, and a heater base 17 to which the pair of electrodes 16 are fixed. The heater base 17 is made of, for example, resin, and includes a connection portion 17*a* that is connected to the battery unit 5 and positioned opposite to the heater element 15, a side wall 17*b* provided upright on the connection portion 17*a*, and a housing port 17*c* for the wick assembly 12 formed as a cut in the circumferential direction of the side wall 17*b*.

The pair of electrodes 16 extend from the connection portion 17*a* until the pair of electrodes 16 protrude from an end surface of the side wall 17*b* in the height direction of the side wall 17*b*, and both ends of the heater element 15 are secured to protruding end portions of the pair of electrodes 16. In the case of the present embodiment, the heater element 15 has a curved shape that is convex in a direction away from the connection portion 17*a*.

A space surrounded by the side wall 17*b* between the heater element 15 and the connection portion 17*a* is used as a housing space 17*d* for the wick assembly 12. The wick assembly 12 is inserted in the radial direction of the heater base 17 through the housing port 17*c* and is housed in the housing space 17*d*. The holder 10 is made of, for example, resin and has a bottomed cylindrical shape. The holder 10 has a peripheral wall 10*a* that defines an outer peripheral edge of the VGU 1 and a connection portion 10*b* that is connected to the tank 7. The connection portion 10*b* is positioned to face the wick 13 in a region where the connection portion 10*b* covers the wick 13.

The wick support 14 is made of, for example, resin, and includes a support portion 14*a* having a curved plate shape and a pair of legs (elastic portions) 14*b* extending from both ends of the support portion 14*a* and having a divergent curved plate shape. The support portion 14*a* has a curved shape along the heater element 15 that is convex in the direction away from the connection portion 17*a* when the wick assembly 12 is housed in the housing space 17*d* of the heater base 17.

The pair of legs 14*b* have flexibility such that the pair of legs 14*b* are deformable to be bent in directions toward each other with the support portion 14*a* as a fulcrum. A protrusion 14*c* for fixing the wick 13 is provided on each of the pair of legs 14*b*. The wick 13 is a liquid holding member having flexibility capable of being shaped and wettability capable of holding a liquid, and is formed of, for example, a fiber material including glass fiber or cotton, and has a rectangular plate shape before being attached to the wick support 14.

A contact portion 13*a* to be brought into contact with the heater element 15 in the assembled VGU 1 is formed at the center in the longitudinal direction of the wick 13, and the contact portion 13*a* is positioned on the support portion 14*a* of the wick assembly 12. At both ends of the wick 13 in the longitudinal direction, respective locking holes 13*b* to which the protrusions 14*c* can be locked are open.

The contact portion 13*a* is formed in a curved shape to extend along the support portion 14*a* and the pair of locking holes 13*b* are locked to the respective protrusions 14*c*. Thus, the wick 13 is fixed to the wick support 14 and the wick assembly 12 is formed.

Figure 5:
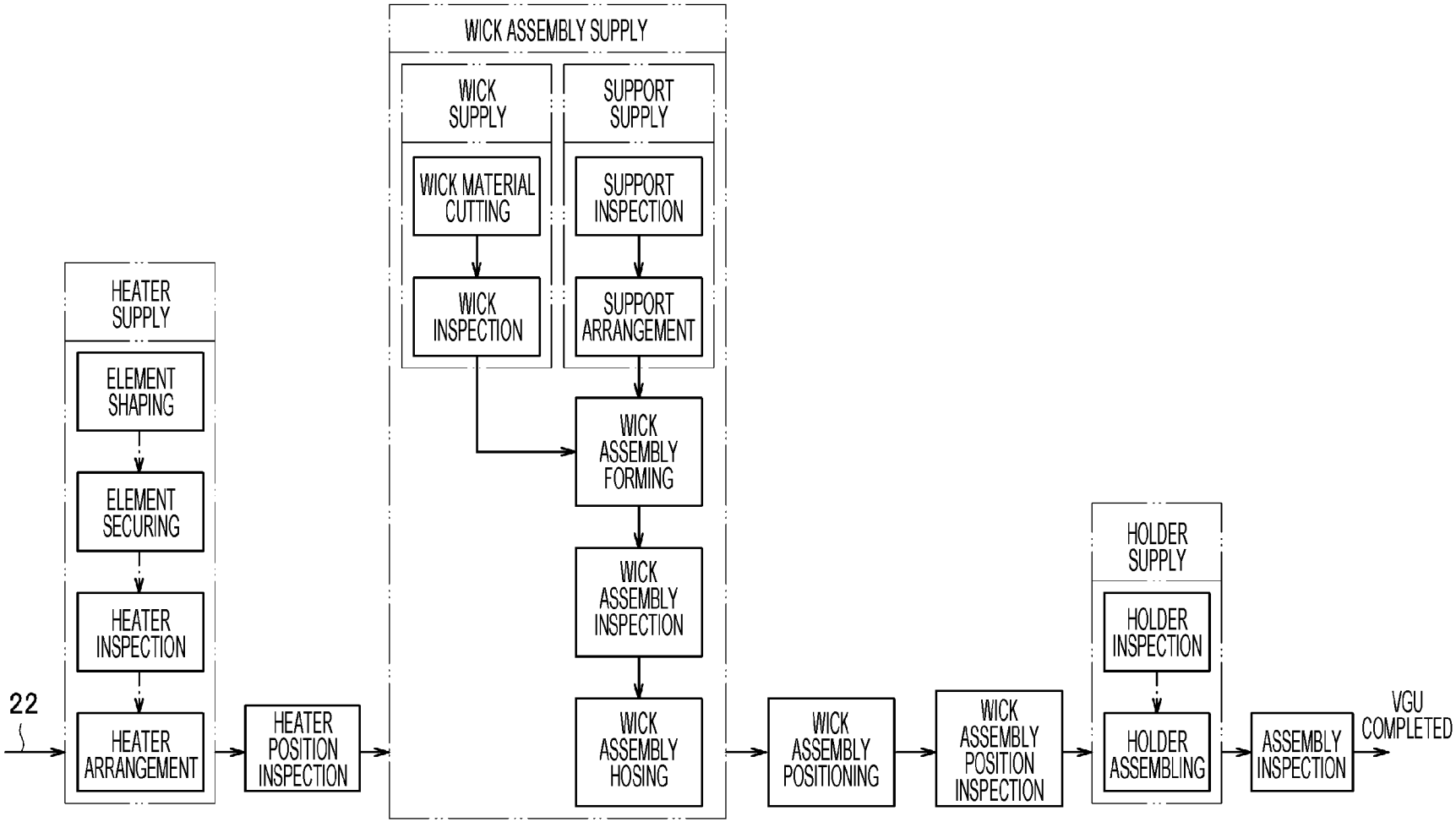
FIG. 5 is a block diagram illustrating a production procedure for the vapor generation unit of FIG. 4.

Hereinafter, a production procedure for the VGU 1 will be described with reference to the block diagram of FIG. 5 illustrating the production procedure for the VGU 1 and the subsequent drawings.

<Heater Supply Step>

Figure 6:
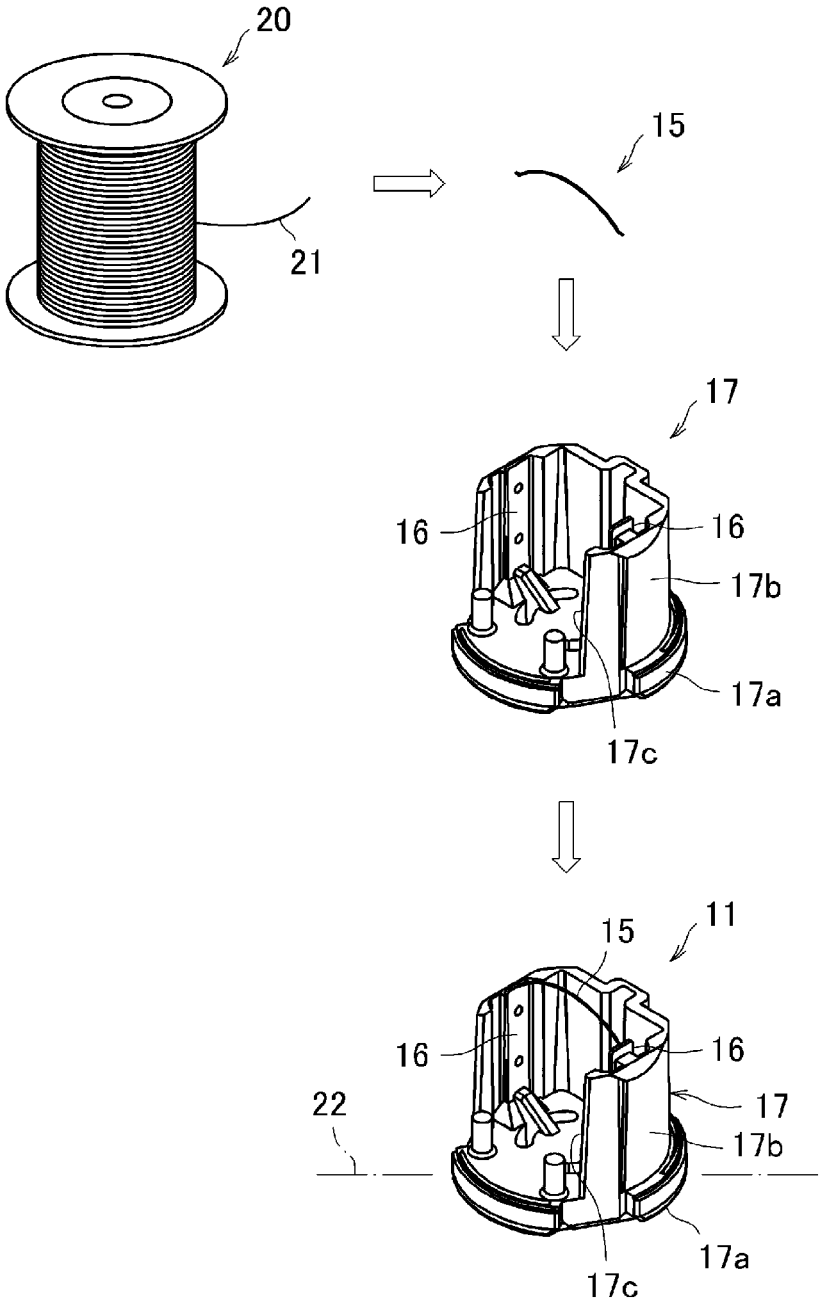
FIG. 6 is an explanatory view of a heater supply step of FIG. 5.

FIG. 6 is an explanatory view of a heater supply step.

(Element Shaping Process)

To produce the heater 11, a wire 21 is drawn out from a wire coil 20 and cut, and the curved heater element 15 is shaped, for example, by pressing a shaping guide (not illustrated) to the wire 21.

The element shaping process may use another shaping means. For example, the curved heater element 15 may be shaped by punching with a die, by a die roll in which the heater element 15 is passed between two or more circular roller members with a die, or by a photoetching method.

(Element Securing Process)

The curved heater element 15 is supplied in a posture to be convex in the direction away from the connection portion 17*a* of the heater base 17, and both ends of the heater element 15 are respectively brought into contact with the pair of electrodes 16 and secured by resistance welding. Note that the heater element 15 may be secured to the electrodes 16, as securing means, by laser welding, ultrasonic welding, or bonding, or may be secured by caulking or soldering as long as the reliability of the securing strength is ensured and the electric resistance of the securing portion can be markedly reduced.

(Heater Inspection Process)

The profile of the heater element 15 secured to the pair of electrodes 16 is inspected. Specifically, whether or not the curvature radius of the heater element 15 falls within an allowable range is inspected, for example, by image recognition using a camera. In addition to the image recognition using the camera, any one of various inspection means such as laser scanning and X-ray inspection is applicable to the inspection of the profile, and the same applies to other inspections described below.

(Heater Arrangement Process)

The inspected heater 11 is arranged in a production line 22 of the VGU 1. The heater 11 may be produced as part of the production procedure for the VGU 1, or may be produced separately from the production procedure for the VGU 1 and supplied to the production line 22.

The same applies to the other components of the VGU 1, that is, the holder 10, the wick assembly 12, the wick 13, and the wick support 14, regardless of the following description. In addition, the components in the VGU 1 may be transported along the production line 22 and supplied and assembled in the section of each step to which the components have arrived, or the components disposed in the production line 22 may be assembled by moving and operating a mechanism or device that performs each step.

<Heater Position Inspection Step>

It is inspected whether the position of the heater 11 supplied to the production line 22 is appropriate or not. Specifically, it is inspected whether or not there is a positional deviation of the heater 11 with respect to the production line 22 and whether or not the orientation is appropriate. When there is an abnormality in the position of the heater 11, since there is a possibility that a defect occurs in each of the subsequent steps, for example, processing of correcting the position of the heater 11 or processing of removing the heater 11 from the production line 22 as a non-conforming product is performed.

<Wick Assembly Supply Step>

Figure 7:
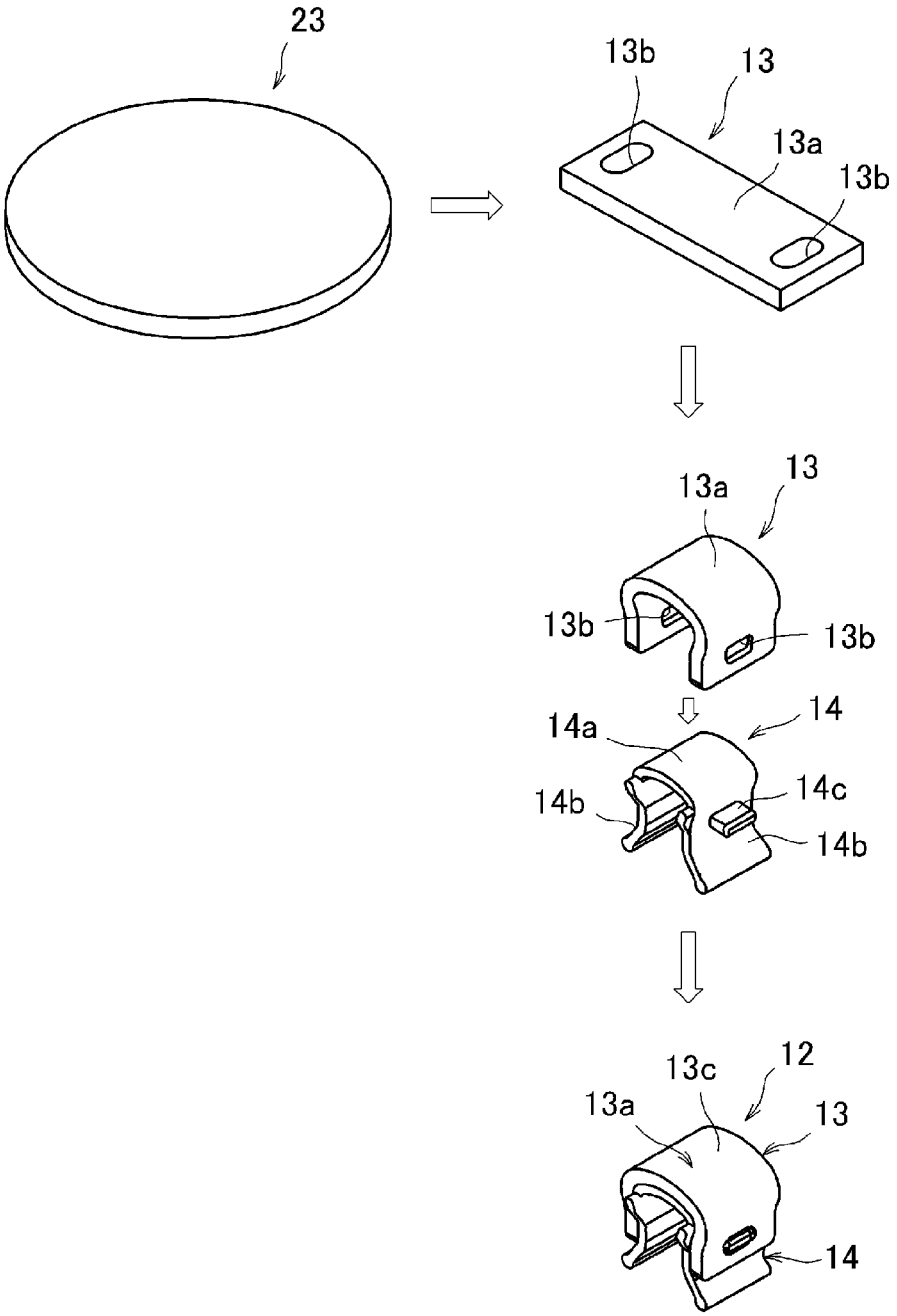
FIG. 7 is an explanatory view of a wick assembly forming process in a wick assembly supply step of FIG. 5.

FIG. 7 is an explanatory view of the procedure up to a wick assembly forming process in a wick assembly supply step.

[Wick Supply]

(Wick Material Cutting Process)

A flat wick 13 is formed by cutting a sheet-shaped or roll-shaped wick material 23 as a material of the wick 13 into, for example, a rectangular flat plate shape, and the pair of locking holes 13*b* are formed in the flat wick 13.

Cutting means used in this process may be punching with a die, or the flat wick 13 may be cut out with a die roll by passing the wick material 23 between roller members. Alternatively, the flat wick 13 may be cut out using a laser cutter, a water cutter, or the like.

(Wick Inspection Process)

The profile of the flat wick 13 is inspected. Specifically, for example, the outer shape, dimensions, thickness, and surface state of the wick 13 are inspected. For example, processing of removing a non-conforming product from the production line 22 is performed.

[Support Supply]

(Support Inspection Process)

The profile of the produced wick support 14 is inspected. Specifically, for example, the outer shape, dimensions, and internal structure of the wick support 14 are inspected. In particular, it is inspected whether or not the wick support 14 has dimensions capable of being assembled to the heater base 17 of the heater 11. For example, processing of removing a non-conforming product from the production line 22 is performed.

(Support Arrangement Process)

The wick support 14 is arranged in the production line 22 or another line such that the wick 13 is attachable to the wick support 14.

(Wick Assembly Forming Process)

As illustrated in FIG. 7, the wick 13 is formed in a curved shape, the contact portion 13*a* of the wick 13 is positioned on the support portion 14*a* of the wick support 14, and the locking holes 13*b* are respectively locked to the pair of protrusions 14*c*. Thus, the wick 13 is attached to the wick support 14 to form the wick assembly 12. The formation of the wick 13 into a curved shape and the attachment of the wick 13 to the wick support 14 can be performed by a forming and attaching device (not illustrated).

(Wick Assembly Inspection Process)

The formed wick assembly 12 is imaged from above using a camera or the like to perform image recognition on the state of an exposed surface 13*c* of the contact portion 13*a*, thereby inspecting whether or not there is a defect such as a step or a hole in the exposed surface 13*c*. The inspection may use another inspection means. For example, by measuring the air flow resistance of the wick 13, it is possible to inspect the presence of a hole or a depression formed in the exposed surface 13*c*, the presence of the difference in density of the fiber material, or the position of the exposed surface 13*c*.

It is also possible to inspect whether or not the curvature radius of the exposed surface 13*c* falls within an allowable range by inspecting the exposed surface 13*c* with X-rays or the like from a lateral side. This allowable range is set in consideration with an allowable error in curvature radius of the heater element 15, an allowable error in assembly of the VGU 1, and the like.

The inspection of the exposed surface 13*c* may be performed within a predetermined range of the arc line length of the exposed surface 13*c* over a predetermined angle with reference to the center of the curvature radius of the exposed surface 13*c*. The inspection range includes at least a region with which the heat generation region of the heater element 15 is expected to come into contact after completion of assembly of the VGU 1. It is also possible to inspect whether or not the height from the center of the curvature radius of the exposed surface 13*c* to the ends of the legs 14*b* of the wick support 14 is appropriate. This is because the situation in which the position of the exposed surface 13*c* is appropriate with respect to the wick support 14 affects the assembly error of the completed VGU 1.

By inspecting the profile of the wick 13 by each inspection as described above, it is possible to prevent leakage of the liquid from the exposed surface 13*c* in the completed VGU 1 and to reliably bring the entire heat generation region of the heater element 15 into contact with the exposed surface 13*c* with an appropriate pressing force. Accordingly, it is possible to prevent disconnection of the heater element 15 due to excessive pressing of the heater element 15 by the wick 13. Further, it is possible to prevent disconnection due to overheating of the heater element 15 based on the presence of a non-contact portion of the wick 13 with respect to the heater element 15. Thus, the liquid infiltrated into the wick 13 can be efficiently and reliably volatilized by the heater element 15.

(Wick Assembly Housing Process)

Figure 8A:
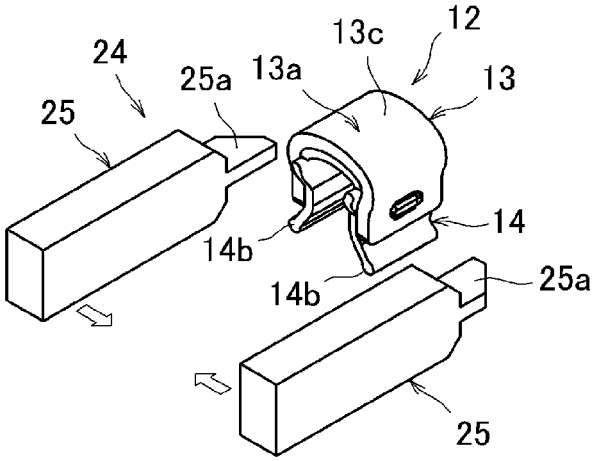
FIG. 8A is a perspective view when a pair of pushers approach each other in a wick assembly housing process of FIG. 5.
Figure 8B:
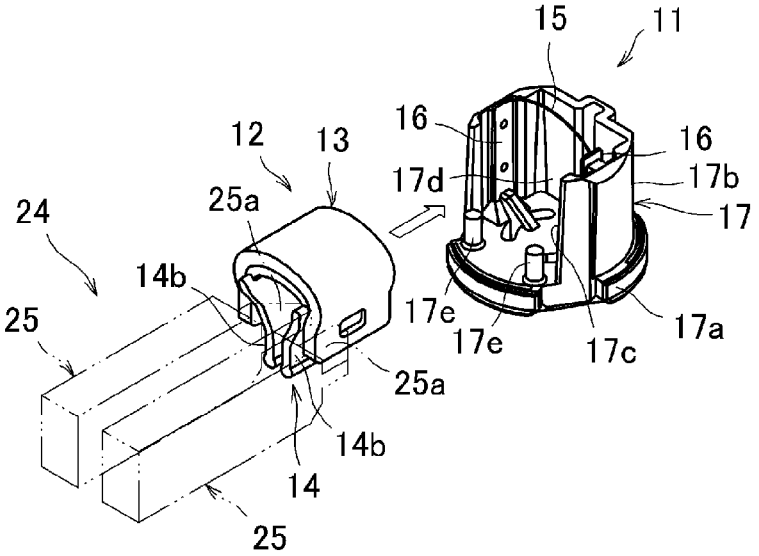
FIG. 8B is a perspective view when claws of the pair of pushers deform a pair of legs of a wick support to approach each other in the wick assembly housing process of FIG. 5.

FIGS. 8A and 8B are explanatory views of a wick assembly housing process. An assembling unit 24 for performing this process includes a pair of pushers 25 capable of moving toward and away from each other. A claw 25*a* is formed at each of distal ends of the pair of pushers 25 in the longitudinal direction. As illustrated in FIG. 8A, the pair of pushers 25 move in directions of arrows toward each other.

Then, as illustrated in FIG. 8B, the claws 25*a* respectively press the pair of legs 14*b* of the wick support 14 in the directions in which the pair of legs 14*b* approach each other to be deformed in a bent manner, and the width between the pair of legs 14*b* is decreased. By decreasing the width between the pair of legs 14*b*, the wick assembly 12 can be inserted from the housing port 17*c*, and the wick assembly 12 is disposed in the housing space 17*d*. At this time, the wick 13 does not come into contact with the heater element 15. The pair of pushers 25 are retracted from the housing port 17*c* after the wick assembly 12 is housed in the housing space 17*d*.

As illustrated in FIG. 8B, a pair of protruding stoppers 17*e* are provided in the vicinity of the housing port 17*c* of the connection portion 17*a* of the heater base 17. The pair of stoppers 17*e* prevent the wick assembly 12 from falling off from the housing port 17*c* after the wick assembly 12 is housed in the housing space 17*d* and before the holder 10 is attached.

<Wick Assembly Positioning Step>

Figure 9A:
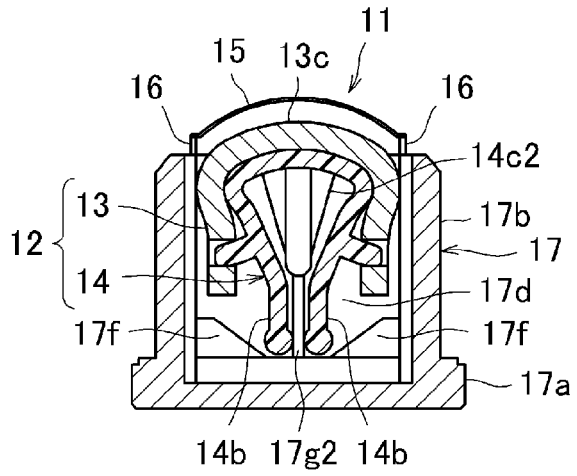
FIG. 9A is a sectional view when the pair of legs are in a vertical posture extending in the axial direction of the heater base in a wick assembly positioning step of FIG. 5.
Figure 9B:
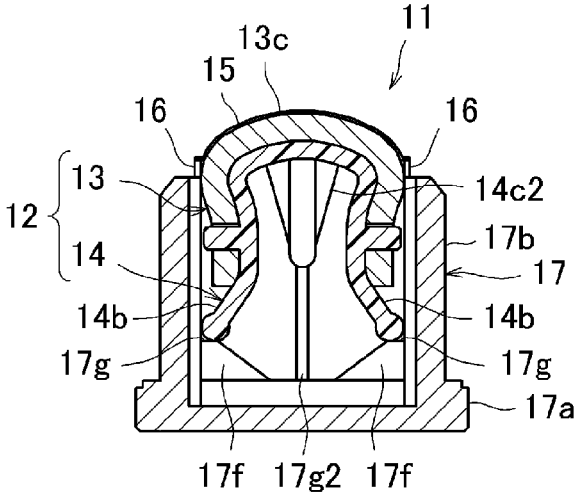
FIG. 9B is a sectional view when end portions of the pair of legs are expanded in the wick assembly positioning step of FIG. 5.
Figure 9C:
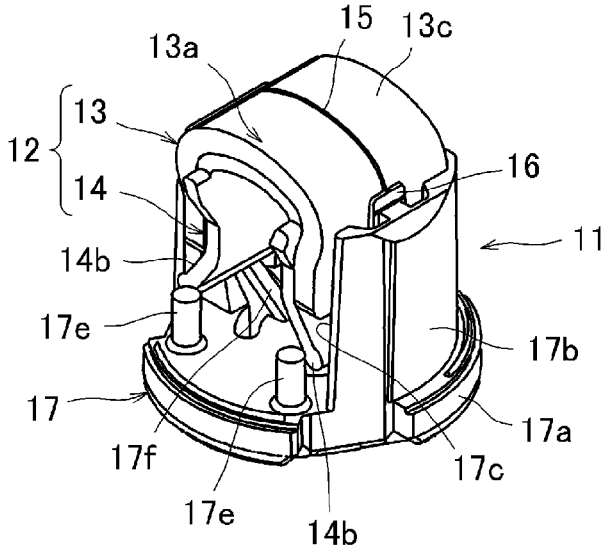
FIG. 9C is a perspective view when a heater element is brought into contact with an exposed surface of a wick in the wick assembly positioning step of FIG. 5.

FIGS. 9A to 9C are explanatory views of a wick assembly positioning step. When the pair of pushers 25 deform the pair of legs 14*b* in a bent manner in the directions toward each other, the pair of legs 14*b* change from a divergent inclined posture to a vertical posture extending in the height direction of the heater base 17 as illustrated in FIG. 9A. In this state, the wick assembly 12 is housed in the housing space 17*d*, but the exposed surface 13*c* of the wick 13 is separated from the heater element 15.

A pair of guides 17*f* are provided in a protruding manner on the connection portion 17*a* of the heater base 17, on both sides in the radial direction of the end portions of the pair of legs 14*b* in the vertical posture. The pair of guides 17*f* are inclined from the connection portion 17*a* to an inner peripheral surface of the side wall 17*b*. When the pair of pushers 25 are retracted, the constraint involving the deformation in a bent manner of the pair of legs 14*b* is released. As illustrated in FIG. 9B, this causes the wick support 14 to expand to its natural state or a state close to its natural state while the end portions of the pair of legs 14*b* are in contact with the pair of guides 17*f*.

The end portions of the pair of legs 14*b* are positioned and stopped at flat locking portions 17*g* positioned at the boundaries between the inclined guides 17*f* and the side wall 17*b* as illustrated in FIG. 9B. Thus, the wick assembly 12 is moved upward toward the heater element 15 in the axial direction (height direction) of the heater base 17 until the wick 13 comes into contact with the heater element 15 at a desired contact position in the housing space 17*d*.

As illustrated in FIG. 9C, as a result of the contact portion 13*a* of the wick 13 being pressed against the heater element 15 with a predetermined pressing force by the upward movement of the wick assembly 12, the heater element 15 is brought into contact with the exposed surface 13*c*. As illustrated in FIGS. 9A and 9B, a protruding line portion 14*c*2 is formed on a lower surface of the support portion 14*a* of the wick support 14 on the side opposite to the exposed surface 13*c* side.

The protruding line portion 14*c*2 extends in the axial direction of the heater base 17 and protrudes in the radial direction of the heater base 17. In contrast, a guide groove (guide) 17*g*2 is formed in the axial direction of the heater base 17 in an inner peripheral surface of the side wall 17*b* of the heater base 17. When the wick assembly 12 is housed in the housing space 17*d*, the protruding line portion 14*c*2 is positioned in the guide groove 17*g*2. Thus, the wick assembly 12 is movable upward in the axial direction along the guide groove 17*g*2 without being inclined.

As described above, the VGU 1 can house the wick assembly 12 in the heater 11 at a non-contact position at which the wick 13 is not in contact with the heater element 15, and includes a positioning mechanism that moves and positions the wick assembly 12 housed in the heater 11 to a contact position at which the wick 13 is in contact with the heater element 15.

Specifically, the wick support 14 has the support portion 14*a* where the contact portion 13*a* of the wick 13 is positioned, and the pair of legs 14*b* for causing the wick assembly 12 to move from the non-contact position to the contact position of the wick 13 with respect to the heater element 15 using an elastic force. The positioning mechanism includes the housing port 17*c*, the housing space 17*d*, the pair of legs 14*b*, the pair of guides 17*f*, the locking portions 17*g*, the protruding line portion 14*c*2, and the guide groove 17*g*2.

More specifically, the positioning mechanism causes the wick assembly 12 to be housed in the housing space 17*d* while positioning the wick 13 at the non-contact position with respect to the heater element 15 by deforming the pair of legs 14*b* against the elastic force of the pair of legs 14*b*. By releasing the deformation of the pair of legs 14*b*, the wick 13 is positioned at the contact position with respect to the heater element 15. That is, the positioning mechanism uses the elastic force generated when the deformation of the pair of legs 14*b* is released to restore the original shape.

Further, the end portions of the pair of legs 14*b* are positioned and stopped at the locking portions 17*g* of the guides 17*f*. Further, the deformation of the pair of legs 14*b* is released with a frictional force caused when the pair of legs 14*b* come into contact with the guides 17*f* of the heater base 17. Further, when the deformation of the pair of legs 14*b* is released, the guide groove 17*g*2 guides the wick assembly 12 in the axial direction along the side wall 17*b* of the heater base 17.

<Wick Assembly Position Inspection Step>

Figure 10:
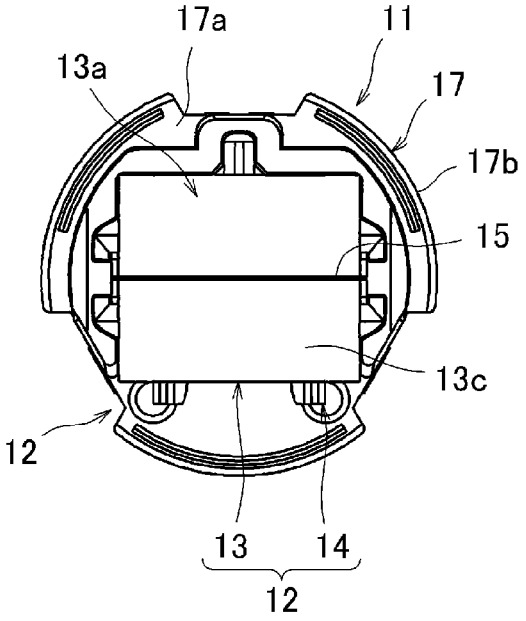
FIG. 10 is an explanatory view of a wick assembly position inspection step of FIG. 5.

FIG. 10 is an explanatory view of a wick assembly position inspection step. In this step, it is inspected whether or not the position of the wick assembly 12 with respect to the heater 11 is appropriate. Specifically, as illustrated in FIG. 10, the exposed surface 13*c* of the wick 13 is imaged from above using a camera or the like to perform image recognition on the state of the exposed surface 13*c*, the contact state of the wick 13 with the heater element 15 is inspected, and, for example, processing of removing a non-conforming product from the production line 22 is performed.

Thus, it is possible to check whether or not the entire heating region of the heater element 15 is in contact with the exposed surface 13*c* in the wick assembly positioning step described above. If there is no non-contact portion of the heater element 15 with respect to the exposed surface 13*c*, disconnection due to overheating of the heater element 15 is prevented, and the liquid infiltrating into the wick 13 can be volatilized by the heater element 15.

<Holder Supply Step>

(Holder Inspection Process)

In this process, the profile of the holder 10 is inspected. Specifically, for example, the outer shape, dimensions, and internal structure of the holder 10 are inspected. In particular, it is inspected whether or not the outer diameter of the peripheral wall 10*a* of the holder 10 is a dimension capable of being assembled to the heater 11 housing the wick assembly 12, and, for example, processing of removing a non-conforming product from the production line 22 is performed.

(Holder Assembling Process)

Figure 11:
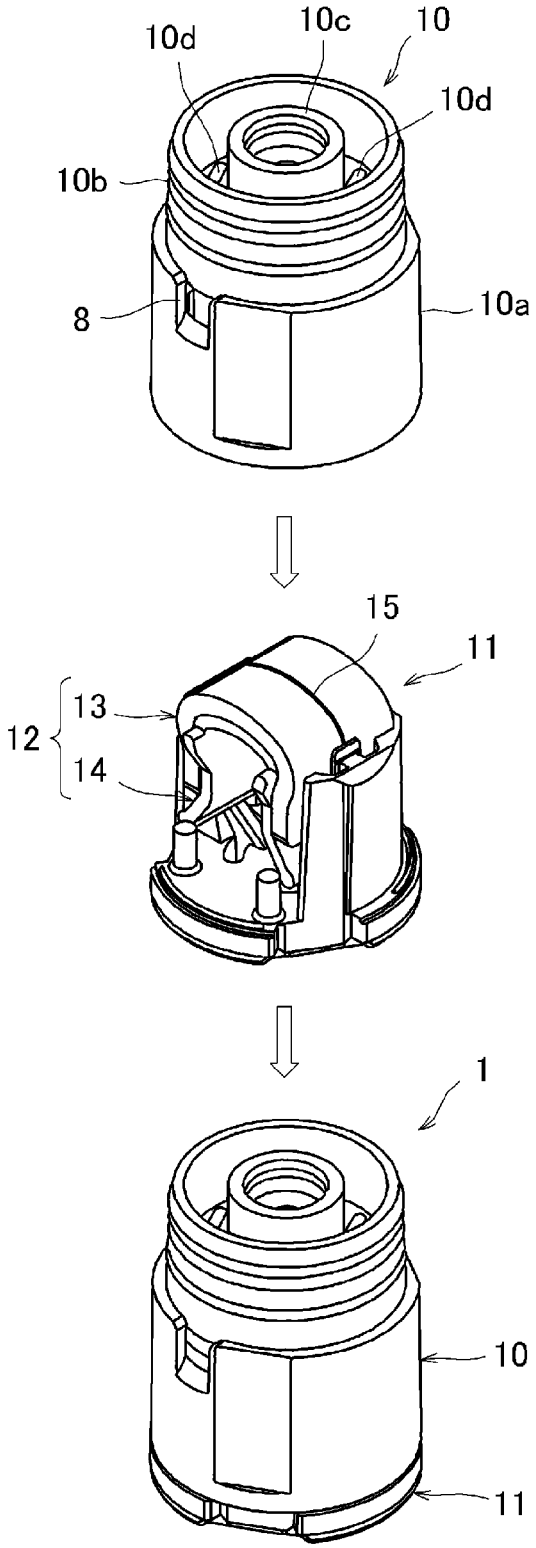
FIG. 11 is an explanatory view of a holder assembling process of FIG. 5.

FIG. 11 is an explanatory view of a holder assembling process. A tubular air guide port 10*c* to which the connection portion 7*e* of the tank 7 is connected is provided at the connection portion 10*b* of the holder 10 so as to protrude in the axial direction. When the liquid infiltrating into the wick 13 is volatilized by the heater element 15, the vapor flows into the flow path 9 through the air guide port 10*c*.

Further, in the connection portion 10*b*, respective liquid guide ports 10*d* are open on both sides of the air guide port 10*c*. The liquid in the tank 7 is guided to the wick 13 through the two liquid guide ports 10*d* formed in the holder 10. The heater 11 housing the wick assembly 12 is covered with and secured to the holder 10, the heater 11 is housed in the holder 10, and in other words, the holder 10 is assembled to the side of the heater element 15 of the heater 11, thereby completing the production of the VGU 1. The holder 10 is secured to the heater 11 by caulking, soldering, laser welding, ultrasonic welding, or bonding, as securing means.

<Assembly Inspection Step>

Figure 12:
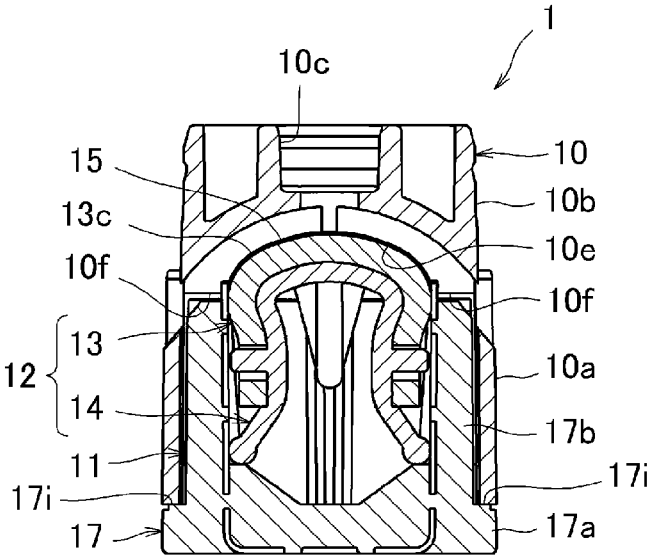
FIG. 12 is a vertical sectional view of the vapor generation unit that has been assembled.
Figure 13:
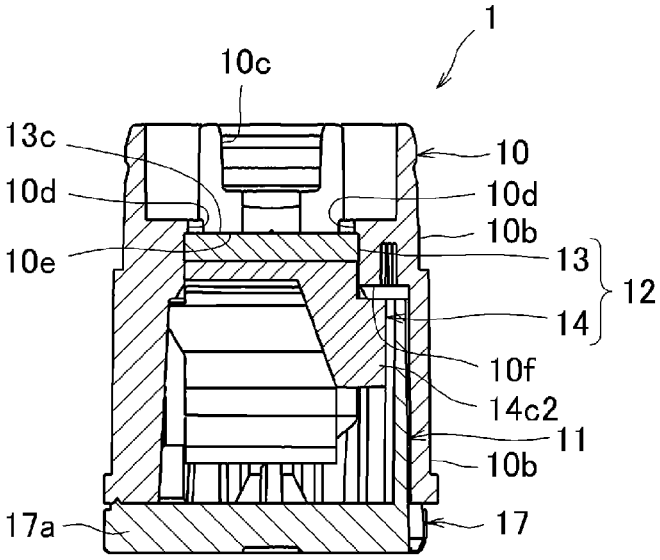
FIG. 13 is a vertical sectional view when the vapor generation unit of FIG. 12 is rotated by 90 degrees in the circumferential direction of the vapor generation unit.

FIGS. 12 and 13 are explanatory views of an assembly inspection step of the VGU 1. In this step, it is inspected whether or not the assembled state of the produced VGU 1 is appropriate. FIG. 12 is a vertical sectional view of the VGU 1. A curved surface 10*e* is formed at the connection portion 10*b* of the holder 10. The curved surface 10*e* is concave inward of the connection portion 10*b*. The curved surface 10*e* faces the exposed surface 13*c* of the wick 13 in the assembled state of the VGU 1, and has a shape along the exposed surface 13*c* of the wick 13. Thus, the curved surface 10*e* abuts on the exposed surface 13*c* with an appropriate pressing force.

A step 10*f* is formed at the boundary between the peripheral wall 10*a* and the curved surface 10*e* of the holder 10, and a step 17*i* is formed at the boundary between the connection portion 17*a* and the side wall 17*b* of the heater base 17. In the assembled state of the VGU 1, an end portion of the peripheral wall 10*a* of the holder 10 abuts on the step 17*i*, but an end portion of the side wall 17*b* of the heater base 17 and the step 10*f* do not abut on each other and are separated from each other with a slight clearance.

FIG. 13 is a vertical sectional view of the VGU 1 rotated by 90 degrees in the circumferential direction of the VGU 1 from FIG. 12. In the assembled state of the VGU 1, the protruding line portion 14*c*2 of the wick support 14 and the step 10*f* do not abut on each other but are separated from each other with a slight clearance. By forming the abutting state and separate state in FIGS. 12 and 13, the contact state of the heater element 15 with respect to the exposed surface 13*c* and the abutting state of the exposed surface 13*c* and the curved surface 10*e* are maintained after the VGU 1 is assembled.

Then, in this step, the VGU 1 is inspected from a lateral side using X-rays or the like to acquire images as illustrated in FIGS. 12 and 13, and the presence of a contact failure of the heater element 15 with respect to the exposed surface 13*c* is detected. Since the presence of a non-contact portion or an excessive contact state may cause disconnection of the heater element 15, for example, processing of removing such a non-conforming product from the production line 22 is performed.

It is also possible to inspect the presence of a contact failure of the heater element 15 with respect to the exposed surface 13*c* based on the height of the completed VGU 1. The application of such an inspection method is based on that the contact state of the heater element 15 with respect to the exposed surface 13*c* is likely to be caused by an assembly error of the VGU 1 on the premise that the individual profile of each component of the VGU 1 conforms to each inspection described above. With this inspection, it is possible to determine the presence of nonconformity because the heater 11 is not accommodated in the holder 10 and the VGU 1 has a height larger than the normal height.

Further, when the wick 13 is brought into a wet state by guiding the liquid into the wick 13 and a rated voltage is applied to the pair of electrodes 16, if an abnormality in the value of the current flowing through the heater element 15 is detected, a contact failure between the heater element 15 and the wick 13 can be detected. An electric resistance measuring device may be connected to the pair of electrodes 16 of the completed VGU 1 to inspect the electric resistance of the VGU 1. If the electric resistance does not fall within a reference range, a contact failure between the heater element 15 and the wick 13 can be detected.

As described above, according to the VGU 1 and the production method for the VGU 1 of the present embodiment, the wick assembly 12 is supplied in the radial direction toward the heater 11 supplied first, and then the holder 10 is supplied in the axial direction and assembled. Thus, since the production procedure for the VGU 1 can be easily automated, the reliability and productivity of the VGU 1 can be improved while ensuring the performance of the VGU 1 required for the inhaler 2.

In particular, in the VGU 1 and the production method for the VGU 1 according to the present embodiment, the wick assembly positioning step is performed by the positioning mechanism described above, whereby the wick assembly 12 is housed in the housing space 17*d* while the wick 13 is positioned at the non-contact position with respect to the heater element 15, and then the wick 13 is positioned at the contact position with respect to the heater element 15. Accordingly, assembly of the wick assembly 12 to the heater 11 and contact of the wick 13 with respect to the heater element 15 can be performed separately.

Thus, it is possible to automatically produce the VGU 1 in which the wick 13 is appropriately brought into contact with the heater element 15 by three components of the holder 10, the heater 11, and the wick assembly 12. Thus, the reliability and productivity of the VGU 1 can be improved. Further, the positioning mechanism of the present embodiment uses the elastic force generated when the deformation of the pair of legs 14*b* is released to restore the original shape. Accordingly, since the VGU 1 can be assembled by a simple mechanism, the productivity of the VGU 1 can be further improved.

Further, the end portions of the pair of legs 14*b* are locked in such a manner as to be caught by the locking portions 17*g*, and due to such a stopper function, the wick 13 is not pressed by an excessive rise of the wick assembly 12 and the heater element 15 is not disconnected. Thus, the reliability of the VGU 1 can be further improved.

Further, the deformation of the pair of legs 14*b* is released with the frictional force caused when the pair of legs 14*b* come into contact with the guides 17*f* of the heater base 17. Thus, the deformation of the pair of legs 14*b* is released relatively slowly, and a sudden upward movement of the wick assembly 12 is suppressed, so that the impact when the wick 13 is brought into contact with and pressed against the heater element 15 is greatly reduced. Accordingly, the risk of disconnection of the heater element 15 due to the wick 13 being pressed is reduced, and the reliability of the VGU 1 can be further improved.

When the deformation of the pair of legs 14*b* is released, the wick assembly 12 is guided in the axial direction along the side wall 17*b* of the heater base 17 by the guide groove 17*g*2 in which the protruding line portion 14*c*2 is positioned. Thus, since the wick assembly 12 is positioned in a normal posture, the wick 13 is prevented from being brought into partial contact with the heater element 15. Accordingly, non-contact of the wick 13 with the heater element 15 does not occur, and the reliability of the VGU 1 can be further improved.

In addition, the heater base 17 is formed with the housing port 17*c* that is continuous with the housing space 17*d* at the side wall 17*b* of the heater base 17. Thus, the wick assembly 12 can be housed and assembled in the housing space 17*d* in the radial direction of the heater base 17 of the heater 11 that does not interfere with the pair of electrodes 16 of the heater 11.

For example, when there is a housing port for the wick assembly 12 in the connection portion 17*a* of the heater base 17, the connection portion 17*a* has to be increased in the radial direction to avoid the electrodes 16 disposed on the surface of the connection portion 17*a* on the side of the battery unit 5. However, in the case of the present embodiment, since the housing port 17*c* is provided in the side wall 17*b* of the heater base 17, the heater base 17 can be easily made compact in the radial direction while avoiding the electrodes 16, and the VGU 1 can be made further compact.

In addition, since the curved surface 10*e* is positioned to face the exposed surface 13*c* in a region where the curved surface 10*e* covers the exposed surface 13*c* in the assembled state of the VGU 1, the possibility that the liquid infiltrated into the wick 13 leaks to the outside of the VGU 1 is reduced. Thus, the reliability of the VGU 1 can be further improved.

Second Embodiment

Hereinafter, a VGU 1 according to a second embodiment and a production method for the VGU 1 will be described with reference to FIGS. 14 to 18. Note that configurations different from those of the first embodiment will be mainly described, and configurations similar to those of the first embodiment are denoted by the same reference numerals in the drawings, or description thereof may be omitted.

Figure 14:
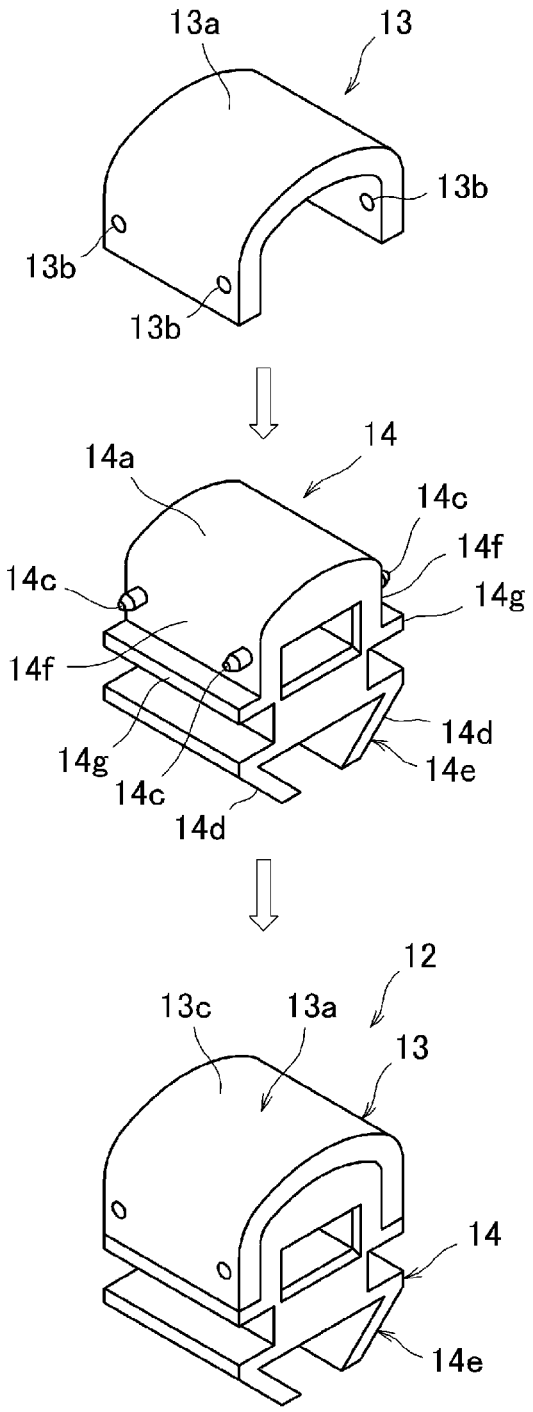
FIG. 14 is an explanatory view of a wick assembly forming process according to a second embodiment of the present invention.

FIG. 14 is an explanatory view of a wick assembly forming process in the case of the present embodiment. Regarding a wick 13, in the case of FIG. 14, two pairs of locking holes 13*b* are formed in the wick 13 in a step similar to the case of the first embodiment, a contact portion 13*a* of the wick 13 is positioned on a support portion 14*a* of a wick support 14 by forming the wick 13 in a curved shape, and in the case of FIG. 14, the locking holes 13*b* are respectively locked to two pairs of protrusions 14*c*. Thus, the wick 13 is attached to the wick support 14 to form the wick assembly 12.

Here, the wick support 14 of the present embodiment includes a plate spring (elastic portion) 14*e* formed by bending a pair of plate members 14*d* toward a central portion of the support portion 14*a* instead of the pair of legs 14*b* of the first embodiment. Moreover, a pair of side walls 14*f* are formed between the support portion 14*a* and the plate spring 14*e*, and the two pairs of protrusions 14*c* are respectively formed on the pair of side walls 14*f*.

In addition, on the pair of side walls 14*f*, protruding line portions 14*g* protruding in the radial direction between the two pairs of protrusions 14*c* and the plate spring 14*e* extend in the width direction of the side walls 14*f*. The wick 13 abuts on the protruding line portions 14*g*, whereby the wick 13 is more reliably positioned with respect to the wick support 14.

Figure 15:
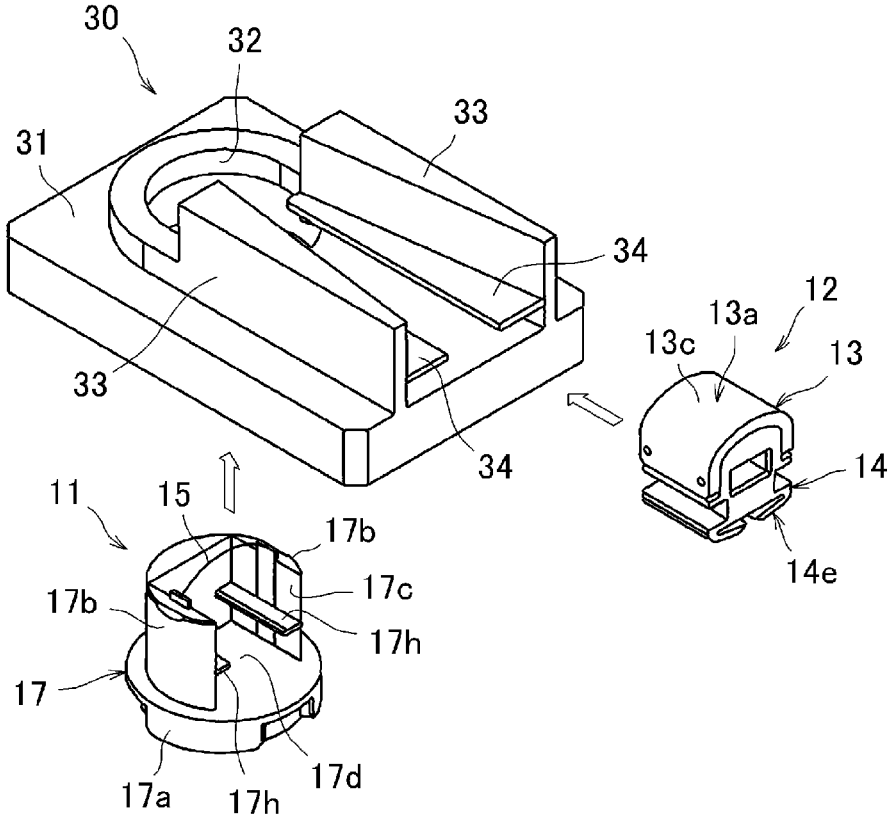
FIG. 15 is an explanatory view of the wick assembly housing process following FIG. 14.
Figure 16:
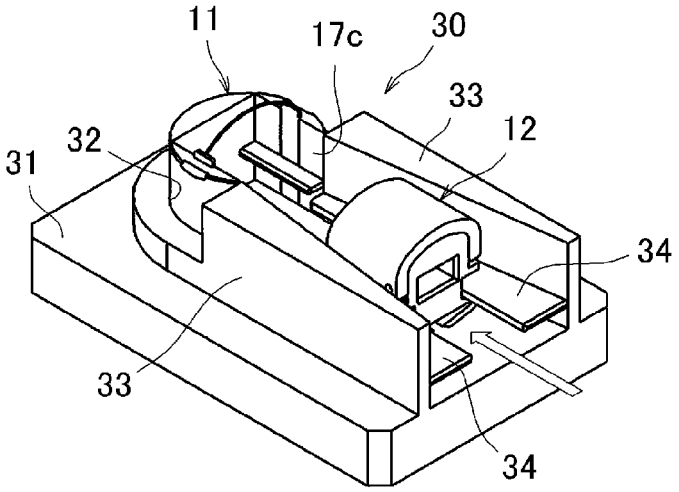
FIG. 16 is an explanatory view of the wick assembly housing process following FIG. 15.
Figure 17:
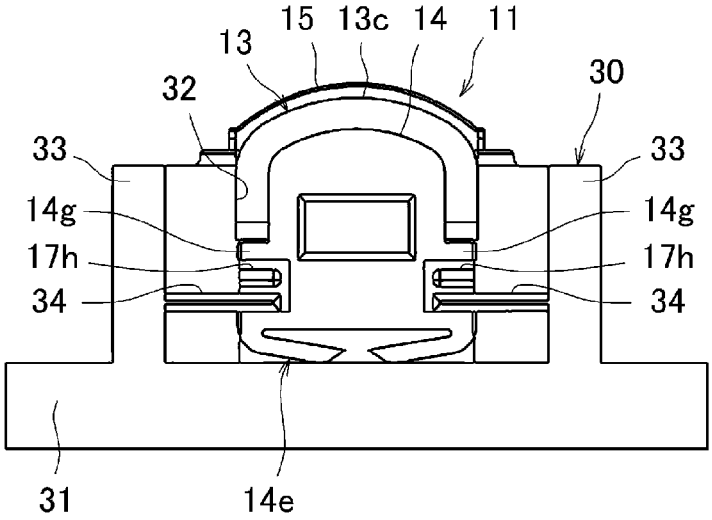
FIG. 17 is an explanatory view of the wick assembly housing process following FIG. 16.

FIGS. 15 to 17 are explanatory views of a wick assembly housing process in the case of the present embodiment. As illustrated in FIG. 15, an assembly unit 30 for performing this process in the case of the present embodiment is provided with a fixing portion 32 for housing and fixing a heater 11 on a base 31 of the assembly unit 30. In addition, a pair of side walls 33 extending to the fixing portion 32 are provided upright on the base 31, and positioning walls 34 protrude from the pair of side walls 33 toward a space therebetween so as to face each other. As illustrated in FIG. 15, the wick assembly 12 is supplied to the heater 11 in a state in which the plate spring 14*e* is folded.

In addition, in the heater 11 of the present embodiment, a pair of protruding line portions 17*h* facing each other in the radial direction of a heater base 17 are formed on an inner peripheral surface of a side wall 17*b* of the heater base 17. Similarly to the locking portions 17*g* in the case of the first embodiment, the pair of protruding line portions 17*h* function as stoppers that restrict movement of the wick assembly 12 beyond a desired contact position of the wick 13 with respect to a heater element 15 when the deformation of the plate spring 14*e* is released. When the deformation of the plate spring 14*e* is released, the wick assembly 12 moves upward in the axial direction of the heater base 17 along the side wall 17*b* of the heater base 17 without being inclined, and hence the side wall 17*b* functions as a guide.

FIG. 16 illustrates a state in which the heater 11 is set at the fixing portion 32 of the assembly unit 30 and the wick assembly 12 is supplied toward the heater 11. The wick assembly 12 is slid between the pair of side walls 33, and is housed in the heater 11 from a housing port 17*c* of the heater 11 fixed to the fixing portion 32. At this time, the plate spring 14*e* is folded and deformed between the base 31 and the pair of positioning walls 34.

FIG. 17 illustrates a state in which the wick assembly 12 has reached the heater 11 in the assembly unit 30. In this state, since the plate spring 14*e* remains folded by the pair of positioning walls 34, an exposed surface 13*c* of the wick 13 is not in contact with the heater element 15.

Figure 18:
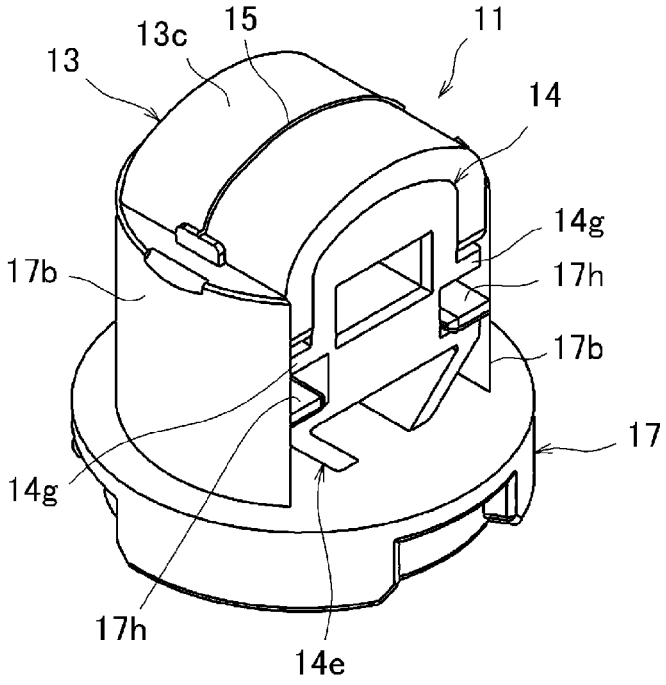
FIG. 18 is an explanatory view of a wick assembly positioning step following FIG. 17.

FIG. 18 illustrates a state in which the assembly unit 30 has been retracted from the heater 11 from the state illustrated in FIG. 17. In this state, the deformation in a folded manner of the plate spring 14*e* is released, the wick assembly 12 moves upward toward the heater element using the elastic force of the plate spring 14*e*, and the exposed surface 13*c* is brought into contact with the heater element 15. Since the release of the deformation in a folded manner of the plate spring 14*e* is restricted by the pair of protruding line portions 17*h* of the heater 11, the wick assembly 12 does not rise excessively and the heater element 15 is not disconnected.

As described above, according to the VGU 1 and the production method for the VGU 1 of the present embodiment, similarly to the case of the first embodiment, the production procedure for the VGU 1 can be automated, and the reliability and productivity of the VGU 1 can be improved while ensuring the performance of the VGU 1 required for an inhaler 2 and making the VGU 1 compact.

At end portions of the pair of side walls 33, the distance between the base 31 and the pair of positioning walls 34 may be ensured to be large, and the distances may be gradually decreased toward the housing port 17*c*. Accordingly, even though the plate spring 14*e* is not folded in advance, the plate spring 14*e* is folded in the course of sliding the wick assembly 12 between the pair of side walls 33, and is housed in the heater 11 from the housing port 17*c*. Thus, since it is not necessary to fold the plate spring 14*e* in advance, the productivity of the VGU 1 is further improved.

Third Embodiment

Hereinafter, a VGU 1 and a production method for the VGU 1 according to a third embodiment will be described with reference to FIGS. 19 to 33. Note that configurations different from those of the first and second embodiments will be mainly described, and configurations similar to those of the first and second embodiments are denoted by the same reference numerals in the drawings, or description thereof may be omitted.

Figure 19:
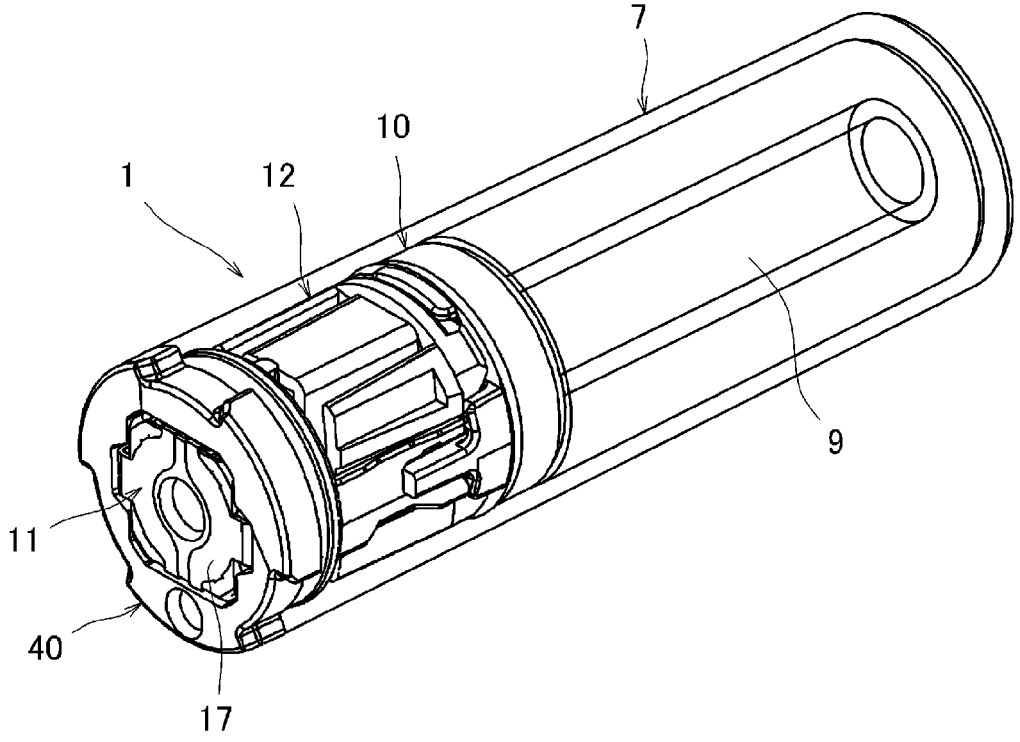
FIG. 19 is a perspective view illustrating a state in which a vapor generation unit according to a third embodiment of the present invention is connected to a tank.
Figure 20:
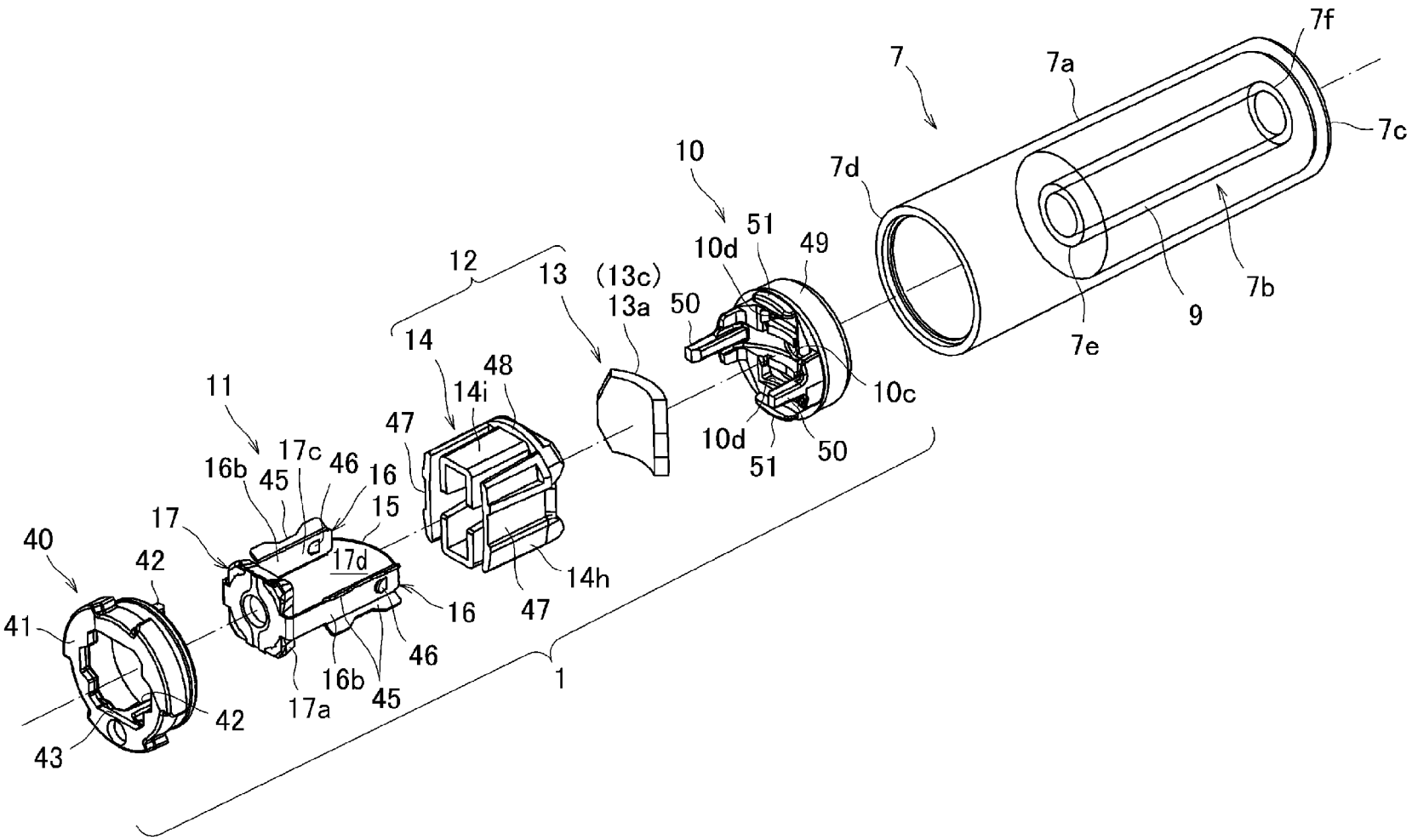
FIG. 20 is an exploded perspective view of FIG. 19.

FIG. 19 is a perspective view of the VGU 1 of the present embodiment connected to a tank 7. FIG. 20 is an exploded perspective view of the VGU 1 of FIG. 19. The VGU 1 differs from those in the first and second embodiments in that a top cap 40 is assembled as a new component to a heater base 17.

In the VGU 1, each component is temporarily assembled through a production procedure (described later), the VGU 1 in the temporarily assembled state is inserted into the tank 7, and then the top cap 40 is connected to an opening 7*d* of the tank 7 by fitting or the like. Accordingly, the VGU 1 is integrally connected to the tank 7 and is fully assembled.

The top cap 40 is made of, for example, resin, has a cap shape, and includes a cap base 41 to which the heater base 17 is fixed. For example, two support protrusions 42 are provided upright on an outer peripheral portion of the cap base 41. A fitting hole 43 to which the heater base 17 is fitted and fixed is formed in a central portion in the radial direction of the cap base 41.

A heater 11 includes a pair of electrodes 16 to which both ends of a heater element 15 are secured, and the heater base 17 on which the pair of electrodes 16 are provided upright. The heater base 17 has a rectangular-plate-shaped connection portion 17*a*, but does not have the side wall 17*b* described in the first and second embodiments. That is, the pair of electrodes 16 are provided upright on the connection portion 17*a* alone without being supported by the side wall 17*b*. A housing port 17*c* for a wick assembly 12 is formed between the pair of electrodes 16. A housing space 17*d* for the wick assembly 12 is a space surrounded by the pair of electrodes 16 between the heater element 15 and the connection portion 17*a*.

Each electrode 16 has a pair of bent portions 45 formed by bending and raising both sides in the width direction of side walls 16*b* of the electrode 16. The bent portion 45 has a shape in which both end sides in the axial direction are widened. Further, a second locking claw 46 cut and raised outward in the radial direction is formed at the center in the width direction of the side wall 16*b* of each electrode 16.

A wick support 14 has a rectangular-parallelepiped outer edge, and recessed linear guide grooves 47 are formed in the axial direction in opposite side walls 14*h* of the wick support 14. In addition, enlarged diameter portions 48 in which the side walls 14*i* are enlarged in diameter in the radial direction are formed in other opposite side walls 14*i* of the wick support 14.

A holder 10 is formed in a cap shape, and includes a disk-shaped holder base 49; two engagement protrusions 50 provided upright in the axial direction of the holder 10, on opposite side walls, that is, peripheral wall portions of the holder base 49; and two protruding portions 51 provided upright in the axial direction on other opposite side walls, that is, peripheral wall portions of the holder base. The holder 10 is attached to the heater 11 on the side of the heater element 15. The target of the attachment in this case is the heater 11.

Figure 21:
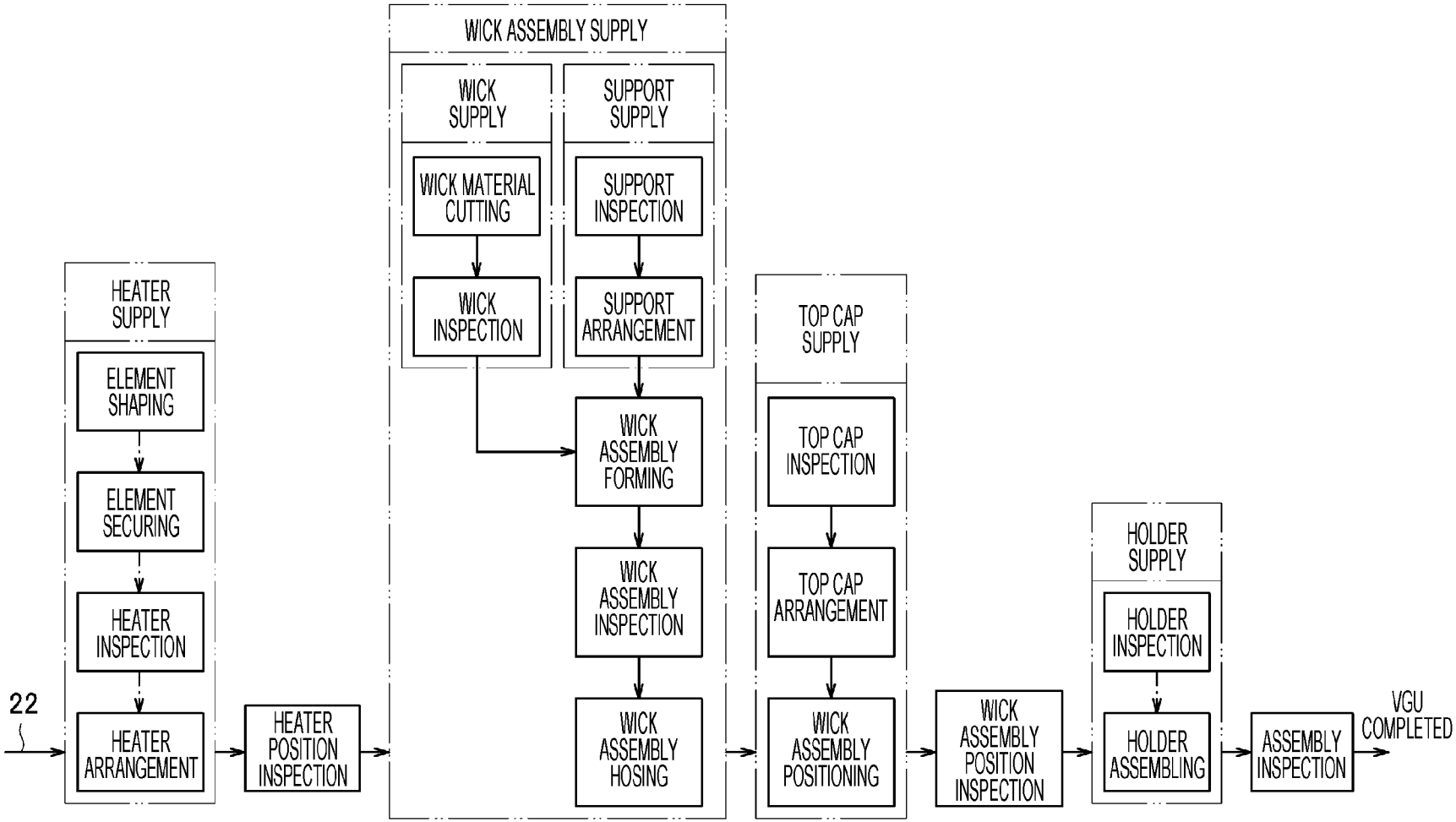
FIG. 21 is a block diagram illustrating a production procedure for the vapor generation unit of FIG. 20.

Hereinafter, with reference to the block diagram of FIG. 21 and the subsequent drawings, a production procedure for the VGU 1 according to the present embodiment will be described mainly in terms of features different from those of the first and second embodiments.

<Heater Supply Step>

Figure 22:
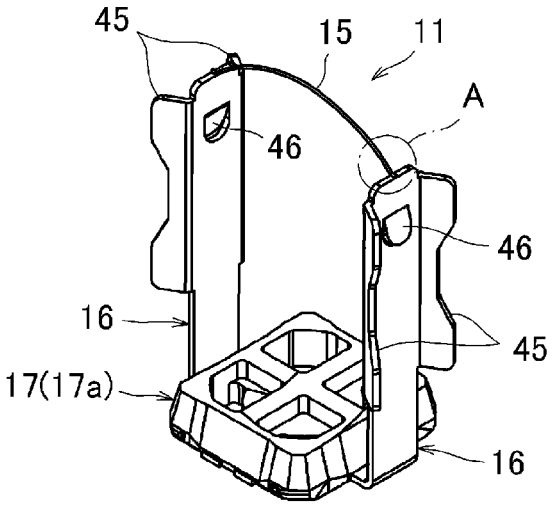
FIG. 22 is a perspective view of a heater formed in a heater supply step of FIG. 21.
Figure 23:
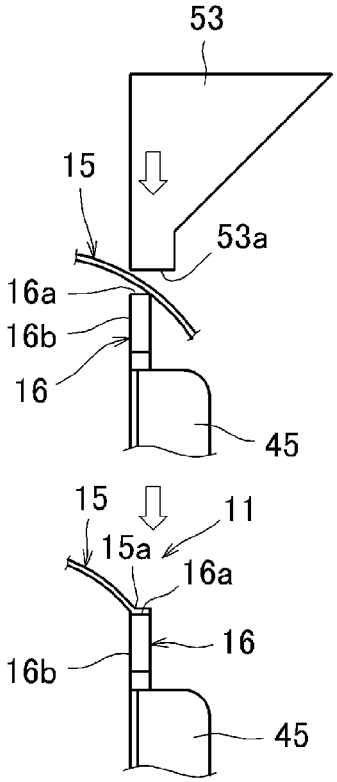
FIG. 23 is an explanatory view of an element securing process of FIG. 21.

FIG. 22 is a perspective view of the heater 11 formed in a heater supply step, and FIG. 23 is an explanatory view of an element securing process and is an enlarged vertical sectional view of a region A of FIG. 22. In the element securing process, a welding head 53 is lowered in a direction indicated by an arrow, and is pressed against an end surface 16*a* of each electrode 16 to weld the heater element 15 to the end surface 16*a*, and then an excessive heater element is cut.

By welding the heater element 15 to the end surface 16*a* using the welding head 53, a bent portion 15*a* of the heater element 15 is formed. The bent portion 15*a* is positioned in the vicinity of a corner portion which is the boundary between the end surface 16*a* and the side wall 16*b* of the electrode 16. Since the heater element 15 extends so as to rise along the side wall 16*b* of the electrode 16, the entire area of the heater element 15 positioned between the pair of electrodes 16 can be brought into contact with an exposed surface 13*c* of a wick 13 without a clearance in a wick assembly positioning step. Accordingly, disconnection due to overheating of the heater element 15 can be reliably prevented, and the reliability of the heater 11 can be improved.

Figure 24:
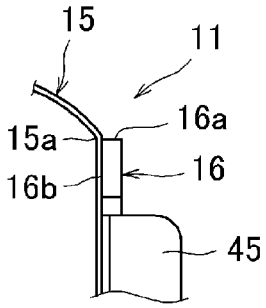
FIG. 24 is a partial sectional view of a heater according to a modification of FIG. 23.

FIG. 24 is a partial sectional view of the heater 11 according to a modification of FIG. 23. In the case of FIG. 24, both outer ends of the heater element 15 are welded to the side walls 16*b* of the electrodes 16. Even in this case, since the bent portion 15*a* is positioned in the vicinity of the corner portion which is the boundary between the end surface 16*a* and the side wall 16*b* of each electrode 16, and the heater element 15 extents to rise along the side wall 16*b*, the clearance between the wick 13 and the heater element 15 can be eliminated, and disconnection due to overheating of the heater element 15 can be reliably prevented.

(Wick Assembly Forming Process)

Figure 25:
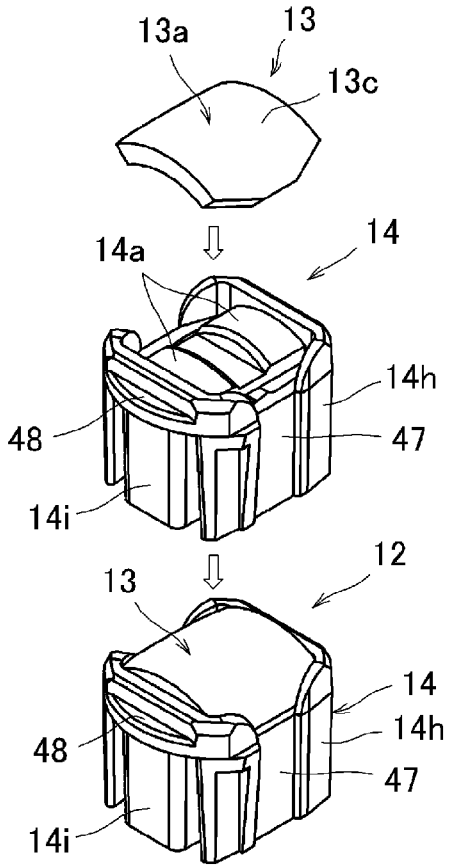
FIG. 25 is an explanatory view of a wick assembly forming process of FIG. 21.

FIG. 25 is an explanatory view of a wick assembly forming process. In the case of the present embodiment, a wick 13 cut into a rectangular plate shape is placed on a support portion 14*a* of the wick support 14. Thus, the wick 13 is attached to the wick support 14 in a curved shape, and hence the wick assembly 12 is formed.

(Wick Assembly Housing Process)

Figure 26:
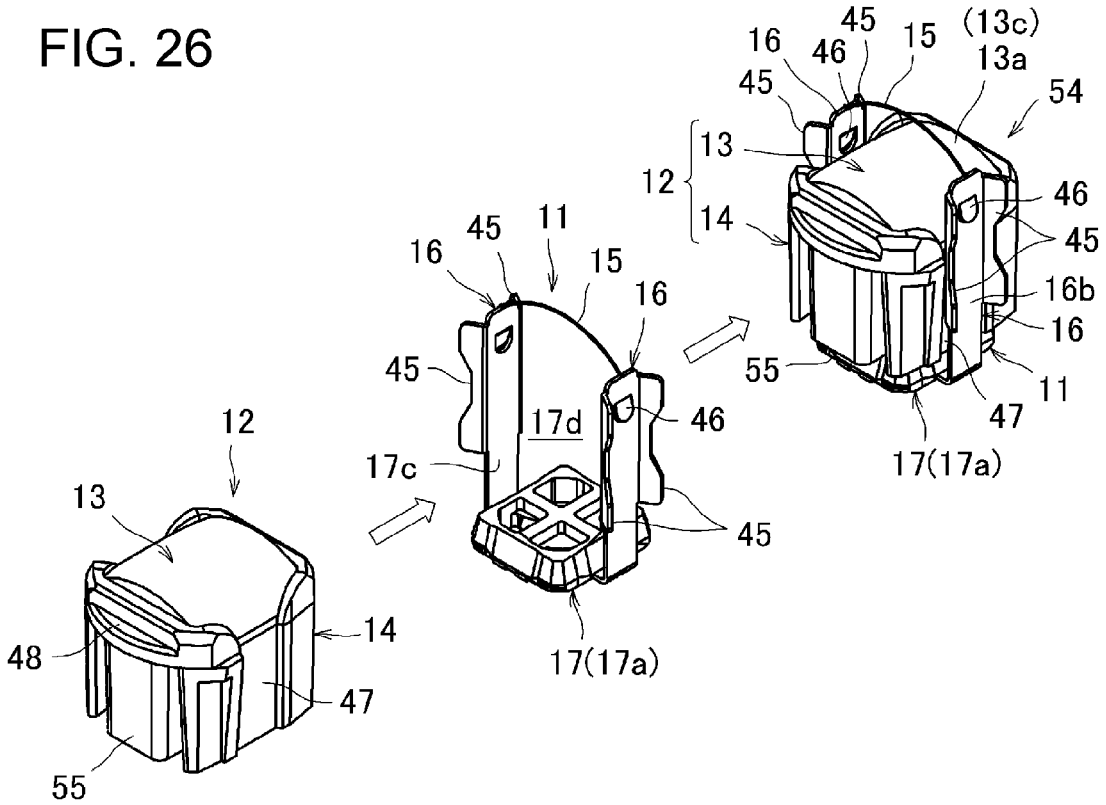
FIG. 26 is an explanatory view of a wick assembly housing process of FIG. 21.

FIG. 26 is an explanatory view of a wick assembly housing process. Also in the case of the present embodiment, similarly to the first and second embodiments, an assembly unit (not illustrated) is used, and the wick assembly 12 is inserted into and disposed in the housing space 17*d* of the heater 11 from the housing port 17*c* of the heater 11 formed between the pair of electrodes 16, that is, in the radial direction of the heater 11, to form a heater assembly (assembly) 54 including the heater 11 and the wick assembly 12.

At this time, a bottom portion 55 of the wick support 14 is made abut on or close to the connection portion 17*a* of the heater base 17, and the electrodes 16 are fitted to and abut on the guide grooves 47 of the opposite side walls 14*h* of the wick support 14. Thus, movement in the radial direction of the wick assembly 12 in the housing space 17*d* is restricted, and the wick assembly 12 is movable along the guide grooves 47 without deviation in the axial direction.

Figure 27:
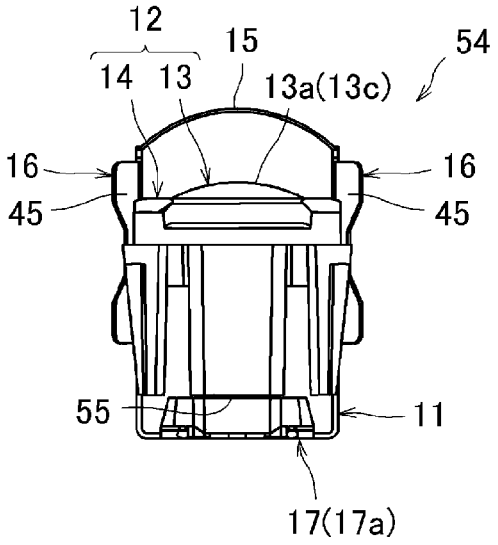
FIG. 27 is a vertical sectional view of a heater assembly of FIG. 26.

FIG. 27 is a vertical sectional view of the heater assembly 54 of the heater 11 and the wick assembly 12. The wick assembly 12 housed in the housing space 17*d* in the wick assembly housing process is placed on the connection portion 17*a* of the heater base 17, and the exposed surface 13*c* of the contact portion 13*a* of the wick 13 is separated from the heater element 15. That is, similarly to the cases of the first and second embodiments, the wick assembly 12 is housed in the housing space 17*d* in the radial direction of the heater 11 while positioning the wick 13 at a non-contact position with respect to the heater element 15.

<Top Cap Supply Step>

Figure 28:
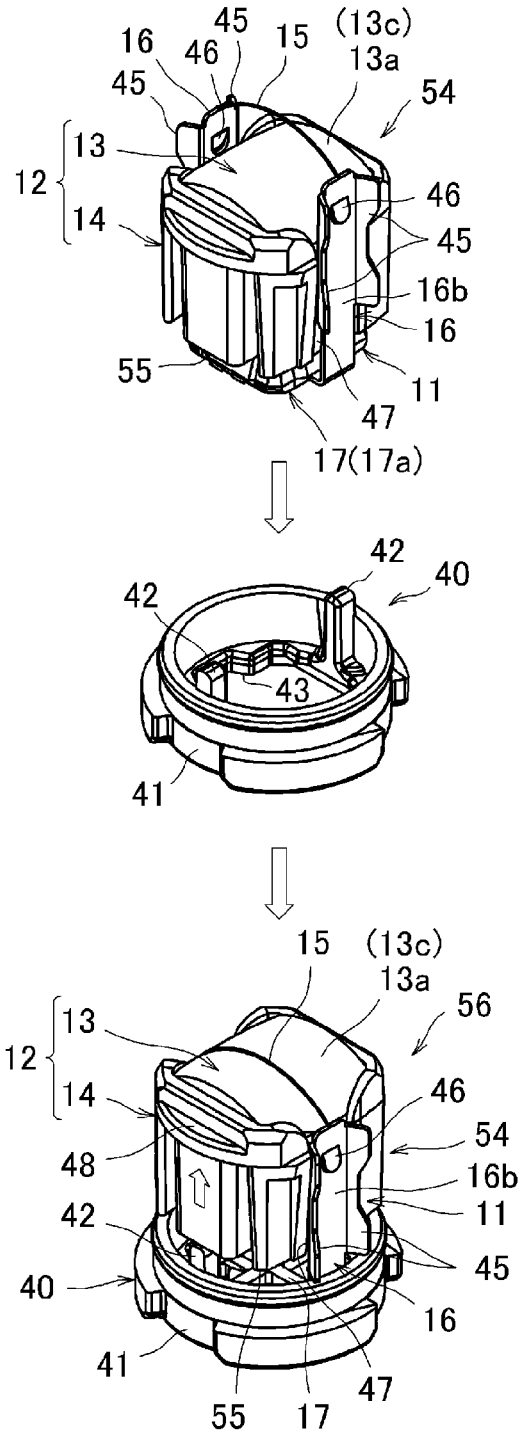
FIG. 28 is an explanatory view of a top cap supply step of FIG. 21.

FIG. 28 is an explanatory view of a top cap supply step.

(Top Cap Inspection Process)

In this process, the profile of the top cap 40 is inspected. Specifically, for example, the outer shape, dimensions, and internal structure of the top cap 40 are inspected.

In particular, when the heater assembly 54 is assembled to the top cap 40, it is inspected whether or not the fitting hole 43 of the cap base 41 has a position and dimensions capable of receiving the heater base 17 in a fitted manner, or whether or not the two support protrusions 42 of the top cap 40 have positions and dimensions capable of abutting on the bottom portion 55 of the wick support 14 of the wick assembly 12, and, for example, processing of removing a non-conforming product from the production line 22 is performed.

(Top Cap Arrangement Process)

The inspected top cap 40 is arranged on the production line 22 of the VGU 1. As illustrated in FIG. 28, the heater assembly 54 is attached, for example, from above the top cap 40 arranged on the production line 22.

Specifically, the top cap 40 is arranged by lowering the entire heater assembly 54 in a direction toward the top cap 40 while, for example, the pair of side walls 16*b* of the electrodes 16 of the heater 11 are held by a mounting device (not illustrated). The heater assembly 54 may be lowered while the heater base 17 is held through the fitting hole 43 of the cap base 41.

(Wick Assembly Positioning Process)

The top cap 40 constitutes a positioning mechanism of the VGU 1 of the present embodiment, and the heater base 17 is fitted to the fitting hole 43 of the cap base 41 by assembling the heater assembly 54 to the top cap 40 from the side of the heater base 17.

Further, by attaching the heater assembly 54 to the top cap 40, the two support protrusions 42 provided upright on the cap base 41 abut on the bottom portion 55 of the wick support 14. Thus, in the housing space 17*d*, only the wick assembly 12 of the heater assembly 54 is lifted up in the arrow direction. Since the lift-up is performed along the electrodes 16 abutting on the guide grooves 47 of the wick support 14, the wick support 14 is not largely deviated from the axial direction at the time of lift-up.

As the wick assembly 12 is lifted up, the wick assembly 12 is moved to and positioned at the contact position of the wick 13 with respect to the heater element 15. Accordingly, the exposed surface 13*c* of the wick 13 comes into contact with the entire area of the heater element 15, and hence a cap assembly 56 including the top cap 40 and the heater assembly 54 is formed.

Figure 29:
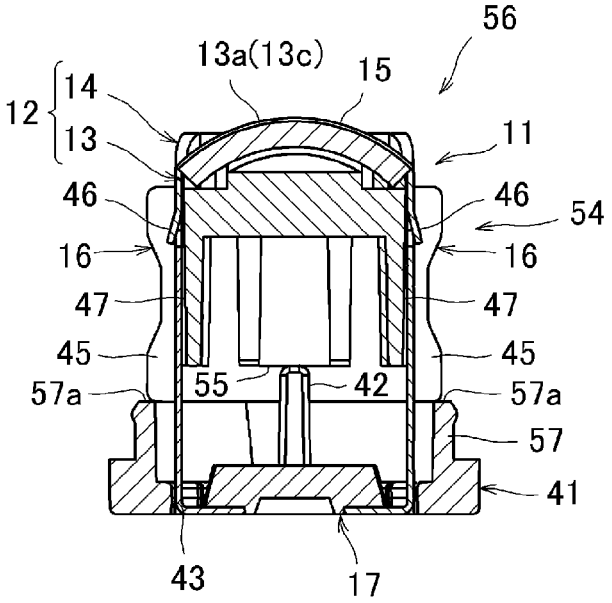
FIG. 29 is a vertical sectional view of a cap assembly of FIG. 28.
Figure 30:
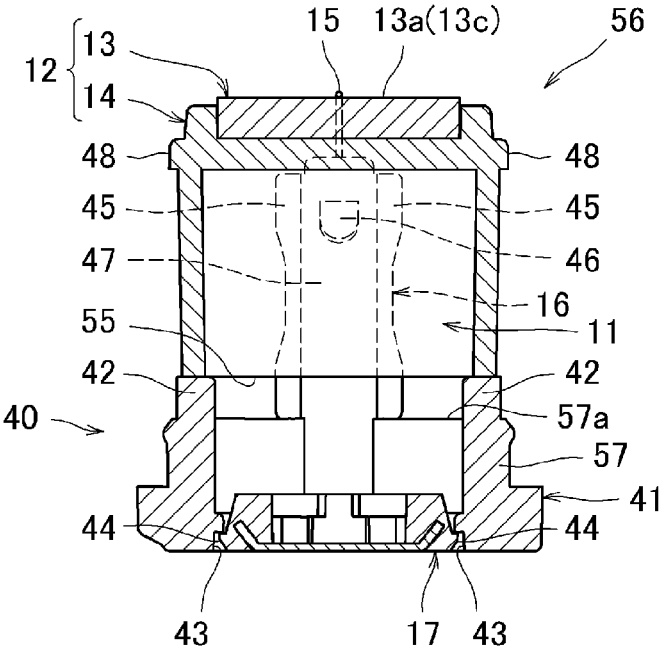
FIG. 30 is a vertical sectional view when the cap assembly of FIG. 29 is rotated by 90 degrees in the circumferential direction of the cap assembly.

FIG. 29 is a vertical sectional view of the cap assembly 56, and FIG. 30 is a vertical sectional view when the cap assembly 56 of FIG. 29 is rotated by 90 degrees in the circumferential direction of the cap assembly 56. Also as illustrated in FIGS. 29 and 30, as the heater assembly 54 is attached to the top cap 40, the positioning mechanism of the VGU 1 of the present embodiment lifts up and moves the wick assembly 12 in the housing space 17*d* in a direction away from the heater base 17 in the axial direction of the heater 11, and positions the wick 13 at the contact position with respect to the heater element 15.

As illustrated in FIG. 30, the connection portion 17*a* of the heater base 17 is formed with, for example, two first locking claws 44 on opposite sides of the outer peripheral edge of the connection portion 17*a*. When the heater base 17 is fitted to the fitting hole 43 of the cap base 41, the four first locking claws 44 of the heater base 17 are locked to the opening edge of the fitting hole 43. The first locking claws 44 function as coming-off stoppers of the heater base 17 with respect to the fitting hole 43.

That is, the positioning by the lift-up described above can be performed through fixing of the heater base 17 to the cap base 41, in other words, through locking of the heater base 17 to the cap base 41 by the fitting hole 43 and the first locking claws 44, and abutting of the support protrusions 42 to the bottom portion 55 of the wick support 14 in the housing space 17*d*.

Further, as the heater base 17 is fitted to the fitting hole 43, lower ends of the pair of bent portions 45 formed at each electrode 16 abut on an upper end surface 57*a* of a side wall 57 of the cap base 41. When an error occurs in the fitting state of the heater base 17 with respect to the fitting hole 43, the heater element 15 may be positioned lower than the normal position. Even in such a case, the pair of bent portions 45 function as stoppers that prevent the heater 11 from excessively falling down and being fixed. This stopper function prevents the heater element 15 from having a failure in the contact state with the wick 13.

<Holder Supply Step>

Figure 31:
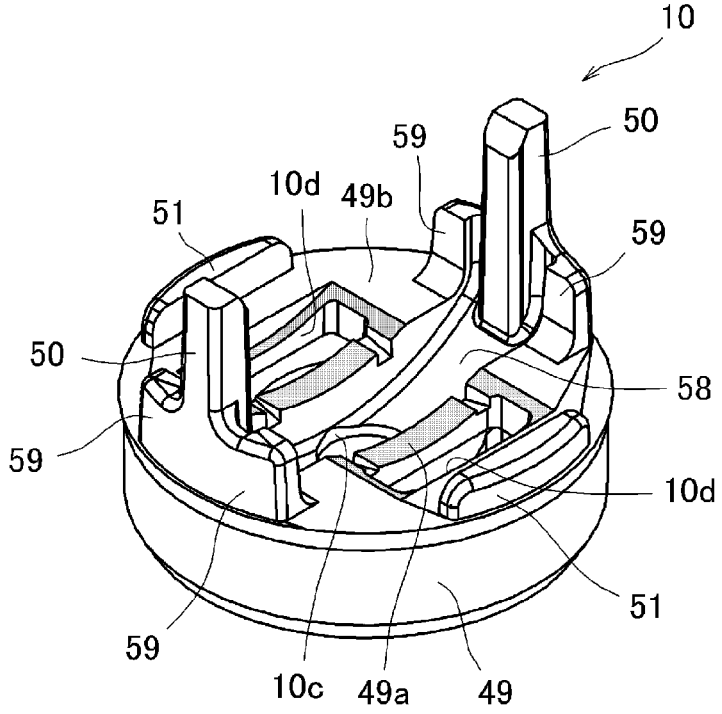
FIG. 31 is a perspective view of a holder of FIG. 20.

FIG. 31 is a perspective view of the holder 10. In the VGU 1, a holder surface 49*a* for holding the wick 13 is formed in a flat end surface 49*b* of the holder base 49 on the side of the wick support 14. A recessed portion 58 is formed in the holder surface 49*a* in the radial direction, and the engagement protrusions 50 are provided upright on both ends of the recessed portion 58. On each of both sides of the engagement protrusions 50 in the circumferential direction, a widened portion 59 continuous with the holder base 49 is formed.

The holder surface 49*a* includes a plurality of partial surfaces colored in gray and positioned on both sides in the radial direction of the recessed portion 58, and these surfaces are formed in a curved shape along the exposed surface 13*c* of the wick 13 as a whole. When the holder 10 is attached to the wick support 14, the recessed portion 58 forms a ventilation space through which vapor volatilized from the wick 13 is ventilated before reaching an air guide port 10*c*.

(Holder Assembling Process)

Figure 32:
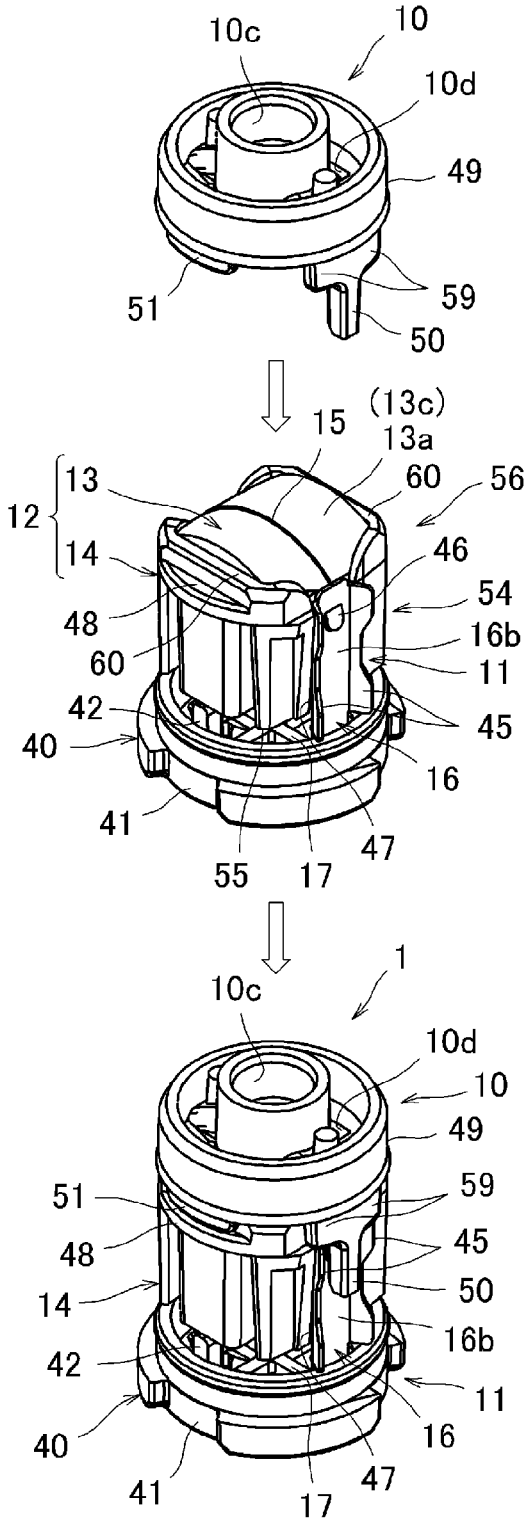
FIG. 32 is an explanatory view of a holder assembling process of FIG. 21.

FIG. 32 is an explanatory view of a holder assembling process. In this process, the holder 10 is assembled so as to cover the cap assembly 56 that has undergone the wick assembly positioning process in the protruding direction of the engagement protrusions 50. This assembly is performed at positions where second locking claws 46 of the pair of electrodes 16 abut on the respective engagement protrusions 50 in the circumferential direction of the cap assembly 56.

Further, by this assembly, an end surface 49*b* of the holder base 49 of the holder 10 and an end surface 60 of the side wall 14*i* of the wick support 14 abut on each other in a state in which the protruding portions 51 of the holder 10 and the enlarged diameter portions 48 of the wick support 14 are separated from each other. Thus, the holder 10 is positioned to the wick support 14 without falling down, and the wick 13 is prevented from being excessively pressed by the holder surface 49*a*.

Figure 33:
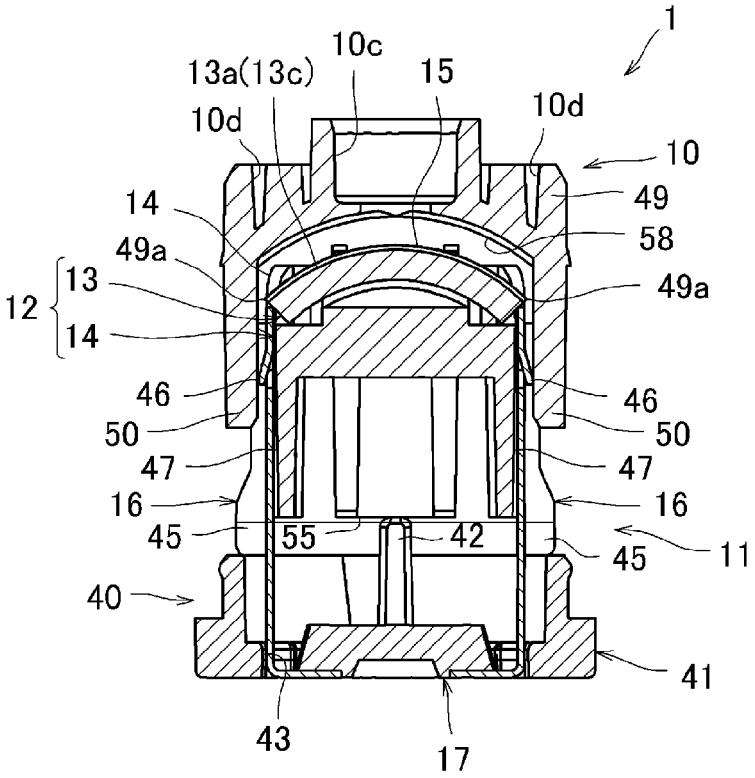
FIG. 33 is a vertical sectional view of the vapor generation unit that has been assembled.

FIG. 33 is a vertical sectional view of the VGU 1 that has been assembled through the holder assembling process. In the holder assembling process, the second locking claws 46 formed on the side walls 16*b* of the electrodes 16 are brought into contact with inner surfaces in the radial direction of the engagement protrusions 50 so as to be pressed outward in the radial direction by its own elasticity, and the holder 10 is fixed by the frictional force generated at this time. Thus, the function of preventing the holder 10 from coming off the cap assembly 56 can be provided.

By positioning and fixing the holder 10 with respect to the cap assembly 56 in this manner, an appropriate contact state between the heater element 15 and the wick 13 performed in the wick assembly positioning process is maintained while a vapor ventilation space between the recessed portion 58 and the wick 13 is ensured. Finally, an assembly inspection step is performed, and thus the production of the VGU 1 is completed.

As described above, according to the VGU 1 and the production method for the VGU 1 of the present embodiment, similarly to the case of the first and second embodiments, the production procedure for the VGU 1 can be automated, and the reliability and productivity of the VGU 1 can be improved while ensuring the performance of the VGU 1 required for an inhaler 2 and making the VGU 1 compact.

Although the embodiments of the present invention have been described above, the present invention is not limited to the above-described embodiments, and various modifications can be made without departing from the spirit of the present invention.

For example, the steps and processes of the respective inspections of the VGU 1 described in the above-described embodiments are not limited to the described content, and any one of various inspection means such as image recognition using a camera, laser scanning, X-ray inspection, pressure inspection, flow amount inspection, infrared inspection, ultraviolet inspection, and color inspection is applicable.

Further, the VGU 1 is applicable to various non-combustion-type flavor inhalers and is not strictly limited to the application to the inhaler 2 described above.

In addition, the shapes and configurations of the components 10, 11, 12, 13, 14, and 40 of the VGU 1 are not strictly limited to those described above.

Further, the positioning mechanism can be variously modified as long as the wick assembly 12 can be housed in the housing space 17*d* at the non-contact position of the wick 13 with respect to the heater element 15 and the wick assembly 12 housed in the housing space 17*d* can be moved to and positioned at the contact position of the wick 13 with respect to the heater element 15.

Specifically, in the case of the first and second embodiments, instead of the legs 14*b* and the plate spring 14*e* formed at the wick support 14, another elastic portion which pushes up the wick assembly 12 after the wick assembly 12 is housed in the housing space 17*d* may be provided. An elastic portion may be provided at the heater base 17 instead of the wick support 14. An elastic portion may be assembled by inserting, for example, a spring into the housing space 17*d* as a separate member from the wick support 14.

In addition, in the first embodiment, the deformation of the pair of legs 14*b* is released with a frictional force, thereby reducing the speed of the upward movement of the wick assembly 12 and reducing the impact when the wick 13 is brought into contact with and pressed against the heater element 15. However, without limiting to this, the rising speed of the wick assembly 12 may be suppressed by bringing a counter portion (not illustrated) into contact with the pair of legs 14*b* and gradually releasing the deformation of the pair of legs 14*b* by, for example, the elastic force of a spring or the viscosity of air or oil.

In the case of the first and second embodiments, in the production method for the VGU 1 described above, the wick assembly 12 is supplied in the radial direction toward the heater 11 supplied first, and then the holder 10 is supplied in the axial direction and assembled. However, without limiting to this, when the above-described elastic member is provided as a separate member, it is also possible to assemble one or more sets of the elastic member and the components 10, 11, and 12 in advance, and appropriately supply this assembly component to a reference component or an assembly component that has already been assembled to produce the VGU 1.

The VGU 1 is supplied with a liquid from a so-called center-flow system tank 7 in which a flow path 9 is formed at the central portion of the tank 7. However, it is also possible to supply the liquid from a side-flow system tank 7 in which a flow path 9 is formed on the side of the peripheral wall 7*a* of the tank 7.

REFERENCE SIGNS LIST

1 vapor generation unit
2 non-combustion-type flavor inhaler
10 holder
11 heater
12 wick assembly
13 wick (liquid holding member)
14 wick support
14*b* leg (elastic portion)
14*e* plate spring (elastic portion)
14*h* side wall
14*i* side wall
15 heater element
16 electrode
16*b* side wall
17 heater base
17*b* side wall (guide)
17*c* housing port
17*d* housing space
17*g* locking portion (stopper)
17*g*2 guide groove (guide)
17*h* protruding line portion (stopper)
40 top cap
41 cap base
42 support protrusion
43 fitting hole
44 first locking claw
47 guide groove
45 bent portion
46 second locking claw
48 enlarged diameter portion
49 holder base
50 engagement protrusion
51 protruding portion
54 heater assembly (assembly)
55 bottom portion of wick support
57 side wall of cap base
57*a* end surface

The invention claimed is:

1. A vapor generation unit for a non-combustion-type flavor inhaler that generates a vapor by heating a liquid, the vapor generation unit comprising:

a wick that holds the liquid;

a wick support to which the wick is attached;

a heater having a housing space in which a wick assembly formed of the wick and the wick support is housed and including a heater element with which the wick comes into contact; and a holder that is assembled to a side of the heater element of an assembly including the heater and the wick assembly, wherein the heater includes a pair of guides that allows the wick assembly to be housed in the housing space at a non-contact position at which the wick is not in contact with the heater element and that causes the wick assembly housed in the housing space to move to a contact position at which the wick is in contact with the heater element to position the wick assembly.

2. The vapor generation unit for a non-combustion-type flavor inhaler according to claim 1, wherein wick support includes an elastic portion that causes the wick assembly to move from the non-contact position to the contact position using an elastic force.

3. The vapor generation unit for a non-combustion-type flavor inhaler according to claim 2, wherein the pair of guides allow the wick assembly to be housed in the housing space while positioning the wick at the non-contact position when the elastic portion is deformed against the elastic force of the elastic portion, and the pair of guides position the wick at the contact position when the deformation of the elastic portion is released.

4. The vapor generation unit for a non-combustion-type flavor inhaler according to claim 3, wherein the heater includes a stopper that restricts movement of the wick assembly beyond the contact position when the deformation of the elastic portion has been released.

5. The vapor generation unit for a non-combustion-type flavor inhaler according to claim 4, wherein the pair of guides release the deformation of the elastic portion with a frictional force caused by contact of the elastic portion with the pair of guides.

6. The vapor generation unit for a non-combustion-type flavor inhaler according to claim 4, wherein the heater includes a guide groove that causes the wick assembly to move in an axial direction of the heater when the deformation of the elastic portion has been released.

7. The vapor generation unit for a non-combustion-type flavor inhaler according to claim 2, wherein the heater has a housing port for the wick assembly in a side wall of the heater.

8. The vapor generation unit for a non-combustion-type flavor inhaler according to claim 1, wherein the holder is positioned to face the wick in a region where the holder covers the wick.

9. The vapor generation unit for a non-combustion-type flavor inhaler according to claim 1, wherein the heater includes a pair of electrodes to which both ends of the heater element are secured, and a heater base on which the pair of electrodes are provided upright, and wherein a top cap is attached from a side of the heater base, and the assembly is attached to the top cap.

10. The vapor generation unit for a non-combustion-type flavor inhaler according to claim 9, wherein the top cap includes a cap base to which the heater base is fixed, and a plurality of support protrusions that are provided upright on the cap base and that abut on a bottom portion of the wick support by attaching the assembly to the top cap.

11. The vapor generation unit for a non-combustion-type flavor inhaler according to claim 10, wherein the wick assembly is housed in the housing space in a radial direction of the heater while the wick is at the non-contact position with the bottom portion of the wick support abutting or close to the heater base, and the wick assembly moves in the housing space in a direction away from the heater base in an axial direction of the heater when the heater base is fixed to the cap base and the support protrusions abut on the wick support to position the wick at the contact position.

12. The vapor generation unit for a non-combustion-type flavor inhaler according to claim 11, wherein the cap base has a fitting hole to which the heater base is fitted, and wherein the heater base includes a first locking claw at an outer peripheral edge of the heater base, the first locking claw being configured to fix the heater base to the cap base by being locked to an opening edge of the fitting hole.

13. The vapor generation unit for a non-combustion-type flavor inhaler according to claim 12, wherein the wick support has guide grooves on which the electrodes abut, on respective opposite side walls of the wick support.

14. The vapor generation unit for a non-combustion-type flavor inhaler according to claim 13, wherein each of the pair of electrodes has a pair of bent portions formed by bending and raising both sides in a width direction of a side wall of the electrode, and wherein one end of each bent portion abuts on an end surface of a side wall of the cap base as the heater base is fitted to the fitting hole.

15. The vapor generation unit for a non-combustion-type flavor inhaler according to claim 14, wherein the holder includes a holder base that is attached to the wick support when the holder is assembled to the side of the heater element of the heater and that forms a ventilation space for the vapor between the holder base and the wick as the holder base is attached to the wick support; and engagement protrusions that are provided upright on the holder base and that abut on the respective side walls of the pair of electrodes in the guide grooves as the holder base is attached to the wick support.

16. The vapor generation unit for a non-combustion-type flavor inhaler according to claim 15, wherein each of the pair of electrodes has a second locking claw formed by cutting and raising each of the side walls outward, and wherein the second locking claw is locked to corresponding one of the engagement protrusions.

17. The vapor generation unit for a non-combustion-type flavor inhaler according to claim 16, comprising:

an enlarged diameter portion in which each of opposite side walls of the wick support is enlarged in diameter in a radial direction; and a protruding portion formed by protruding each of opposite side walls of the holder in an axial direction of the holder, wherein the protruding portion abuts on the enlarged diameter portion as the holder is attached to the assembly.

18. A production method for a vapor generation unit for a non-combustion-type flavor inhaler that generates a vapor by heating a liquid, the vapor generation unit including a wick that holds the liquid, a wick support to which the wick is attached, a heater that houses a wick assembly formed of the wick and the wick support and that includes a heater element with which the wick comes into contact, and a holder that is assembled to a side of the heater element of an assembly including the heater and the wick assembly, the method comprising:

a heater supply step of supplying the heater;

a wick assembly supply step of forming the wick assembly and causing the wick assembly to be housed in a housing space of the heater at a non-contact position at which the wick is not in contact with the heater element;

a wick assembly positioning step of causing the wick assembly housed in the housing space at the non-contact position to move to a contact position at which the wick is in contact with the heater element to position the wick assembly; and a holder supply step of assembling the holder to the heater in which the wick assembly has been positioned, wherein the wick assembly positioning step causes the wick assembly to move from the non-contact position to the contact position using an elastic force of an elastic portion.

19. The production method for the vapor generation unit for a non-combustion-type flavor inhaler according to claim 18, wherein the wick assembly supply step causes the wick assembly to be housed in the housing space while positioning the wick at the non-contact position by deforming the elastic portion against the elastic force of the elastic portion, and wherein the wick assembly positioning step positions the wick at the contact position by releasing the deformation of the elastic portion.

20. The production method for the vapor generation unit for a non-combustion-type flavor inhaler according to claim 19, wherein the wick assembly positioning step restricts movement of the wick assembly beyond the contact position when the deformation of the elastic portion has been released.

21. The production method for the vapor generation unit for a non-combustion-type flavor inhaler according to claim 20, wherein the wick assembly positioning step releases the deformation of the elastic portion with a frictional force caused by contact of the elastic portion with the heater.

22. The production method for the vapor generation unit for a non-combustion-type flavor inhaler according to claim 20, wherein the wick assembly positioning step causes the wick assembly to move in an axial direction of the heater when the deformation of the elastic portion has been released.

23. The production method for the vapor generation unit for a non-combustion-type flavor inhaler according to claim 18, wherein the wick assembly supply step causes the wick assembly to be housed in a radial direction of the heater.

24. The production method for the vapor generation unit for a non-combustion-type flavor inhaler according to claim 18, wherein the holder supply step positions the holder to face the wick in a region where the holder covers the wick.

25. The production method for the vapor generation unit for a non-combustion-type flavor inhaler according to claim 18, wherein the heater includes a pair of electrodes to which both ends of the heater element are secured, and a heater base on which the pair of electrodes are provided upright, wherein the vapor generation unit further includes a top cap to which the assembly is attached from a side of the heater base, and wherein the wick assembly positioning step causes the wick assembly to move from the non-contact position to the contact position in the housing space as the assembly is attached to the top cap.

26. The production method for the vapor generation unit for a non-combustion-type flavor inhaler according to claim 25, wherein the top cap includes a cap base to which the heater base is fixed, and a plurality of support protrusions that are provided upright on the cap base and that abut on a bottom portion of the wick support, wherein the wick assembly supply step causes the wick assembly to be housed in the housing space in a radial direction of the heater while positioning the wick at the non-contact position by making the bottom portion of the wick support abut on or close to the heater base, and wherein the wick assembly positioning step causes, by attaching the heater to the top cap, the wick assembly to move in the housing space in a direction away from the heater base in an axial direction of the heater through the fixing of the heater base to the cap base and the abutting of the support protrusions on the wick support to position the wick at the contact position.

27. A production method for a vapor generation unit for a non-combustion-type flavor inhaler that generates a vapor by heating a liquid, the vapor generation unit including a wick that holds the liquid, a wick support to which the wick is attached, a heater that houses a wick assembly formed of the wick and the wick support and that includes a heater element with which the wick comes into contact, and a holder that is assembled to a side of the heater element of an assembly including the heater and the wick assembly, the method comprising:

a heater supply step of supplying the heater;

a wick assembly supply step of forming the wick assembly and causing the wick assembly to be housed in a housing space of the heater at a non-contact position at which the wick is not in contact with the heater element;

a wick assembly positioning step of causing the wick assembly housed in the housing space at the non-contact position to move to a contact position at which the wick is in contact with the heater element to position the wick assembly; and a holder supply step of assembling the holder to the heater in which the wick assembly has been positioned, wherein the heater includes a pair of electrodes to which both ends of the heater element are secured, and a heater base on which the pair of electrodes are provided upright, wherein the vapor generation unit further includes a top cap to which the assembly is attached from a side of the heater base, and wherein the wick assembly positioning step causes the wick assembly to move from the non-contact position to the contact position in the housing space as the assembly is attached to the top cap.

* * * * *